US011391027B1

(12) United States Patent
Ali

(10) Patent No.: US 11,391,027 B1
(45) Date of Patent: Jul. 19, 2022

(54) DRAIN STRAINER

(71) Applicant: Naushad Ali, Woodinville, WA (US)

(72) Inventor: Naushad Ali, Woodinville, WA (US)

(73) Assignee: Naushad Ali, Woodinville, WA (US)

( * ) Notice: Subject to any disclaimer, the term of this patent is extended or adjusted under 35 U.S.C. 154(b) by 0 days.

(21) Appl. No.: 17/461,599

(22) Filed: Aug. 30, 2021

(51) Int. Cl.

| | |
|---|---|
| ***E03C 1/26*** | (2006.01) |
| ***A47K 1/14*** | (2006.01) |
| ***E03C 1/262*** | (2006.01) |
| ***E03C 1/23*** | (2006.01) |

(52) U.S. Cl.
CPC ..... *E03C 1/262* (2013.01); *A47K 1/14* (2013.01); *E03C 1/2306* (2013.01)

(58) Field of Classification Search
CPC . E03C 1/262; E03C 1/264; E03C 1/26; E03C 1/2306; A47K 1/14
See application file for complete search history.

(56) References Cited

U.S. PATENT DOCUMENTS

| | | | | |
|---|---|---|---|---|
| 769,001 | A | 8/1904 | Lawrence | |
| 1,424,022 | A | 7/1922 | Lacoste | |
| 1,515,073 | A | 11/1924 | Savard | |
| 1,756,290 | A | 4/1930 | Hibner | |
| 1,770,639 | A | 7/1930 | West et al. | |
| 1,950,817 | A * | 3/1934 | Rossman | E03C 1/264 4/291 |
| 2,075,443 | A * | 3/1937 | Kirschner | E03C 1/262 4/287 |
| 2,285,833 | A | 6/1942 | Platt | |
| 2,331,055 | A | 10/1943 | Smith | |
| 2,337,331 | A * | 12/1943 | Kirschner | E03C 1/262 4/287 |
| 2,481,312 | A * | 9/1949 | Kirschner | E03C 1/262 4/287 |

(Continued)

FOREIGN PATENT DOCUMENTS

| | | |
|---|---|---|
| CA | 2 898 800 A1 | 8/2013 |
| CN | 201762779 U | 3/2011 |

(Continued)

OTHER PUBLICATIONS

HairFree Pop-Up Stopper, http://www.homedepot.com/h_d1/N-5yc1v/R-203249499/h_d2/ProductDisplay?catalogId=, download date Sep. 24, 2012, 2 pages.

*Primary Examiner* — Janie M Loeppke
(74) *Attorney, Agent, or Firm* — Seed IP Law Group LLP

(57) ABSTRACT

The present disclosure is directed to a strainer cartridge that may be inserted into a drain of a drain system. The strainer cartridge includes an upper strainer portion and a lower strainer portion that are telescopically engaged with each other such that the upper strainer portion is moved into and out of the lower strainer portion telescopically. The strainer cartridge has a compressed position in which a drain opening of the drain is sealed off such that fluid collects within a fluid basin in fluid communication with the drain, and the strainer cartridge has an expanded position in which fluid may flow through the drain opening and the upper and lower strainer portions. When in the compressed position, the lower strainer portion is telescopically inset within the lower strainer portion, and, when in the expanded position, the upper strainer portion extends outward from the lower strainer portion.

20 Claims, 14 Drawing Sheets

(56) References Cited

U.S. PATENT DOCUMENTS

| | | | |
|---|---|---|---|
| 2,698,441 | A | 1/1955 | Shobe |
| 3,333,815 | A | 8/1967 | Downey et al. |
| 3,588,928 | A | 6/1971 | Hiertz |
| 3,596,294 | A | 8/1971 | Hoffman |
| 3,800,339 | A | 4/1974 | Bergin |
| 3,802,001 | A | 4/1974 | Richards |
| 3,813,708 | A | 6/1974 | Hamburg |
| 3,911,508 | A | 10/1975 | Goldberg |
| 4,045,351 | A | 8/1977 | Peterson |
| D246,109 | S | 10/1977 | Rosaen |
| 4,207,631 | A | 6/1980 | Baggey |
| 4,276,662 | A | 7/1981 | Young |
| 4,369,531 | A | 1/1983 | Swanson |
| 4,380,834 | A | 4/1983 | Wentz |
| 4,571,751 | A | 2/1986 | Barlow |
| 4,597,112 | A | 7/1986 | Cuschera |
| 4,720,877 | A | 1/1988 | Watts |
| 4,860,390 | A | 8/1989 | Ohta |
| 4,932,082 | A | 6/1990 | Ridgeway |
| 5,072,461 | A | 12/1991 | Logsdon |
| 5,165,118 | A | 11/1992 | Cendrowski |
| 5,369,815 | A | 12/1994 | Martin |
| D357,306 | S | 4/1995 | Lenox |
| 5,592,701 | A | 1/1997 | Smith |
| 5,724,684 | A | 3/1998 | Paar |
| 5,858,494 | A | 1/1999 | Cherkas et al. |
| 5,915,847 | A | 6/1999 | Spears |
| 6,058,526 | A | 5/2000 | Parisi et al. |
| 6,067,669 | A | 5/2000 | Peterson et al. |
| 6,108,828 | A | 8/2000 | Cheng |
| 6,145,136 | A | 11/2000 | Parisi et al. |
| 6,263,518 | B1 | 7/2001 | Magtanong |
| D450,106 | S | 11/2001 | Herr |
| D454,941 | S | 3/2002 | Dietzel |
| 6,418,568 | B1 | 7/2002 | Briggs et al. |
| 6,845,528 | B2 | 1/2005 | Bantz |
| 7,013,500 | B1 | 3/2006 | Lin |
| 7,442,296 | B2 | 10/2008 | Chong et al. |
| 7,485,318 | B2 | 2/2009 | Koskinen et al. |
| 7,625,488 | B2 | 12/2009 | Blackburn |
| 7,704,386 | B2 | 4/2010 | Ventura |
| D643,508 | S | 8/2011 | Wilkinson et al. |
| D644,072 | S | 8/2011 | McDonald et al. |
| 8,011,030 | B2 | 9/2011 | Li |
| 8,214,942 | B2 | 7/2012 | Yang et al. |
| D691,418 | S | 10/2013 | Minton et al. |
| 8,590,065 | B2 | 11/2013 | Ali et al. |
| 8,813,272 | B2 | 8/2014 | Ball |
| D749,706 | S | 2/2016 | Johansen |
| D756,483 | S | 5/2016 | Ruprecht |
| 9,371,636 | B2 | 6/2016 | Ali et al. |
| 9,499,962 | B2 | 11/2016 | Joseph |
| 9,518,383 | B2 | 12/2016 | Lesmeister |
| D783,134 | S | 4/2017 | Kamegie |
| D792,562 | S | 7/2017 | Ali |
| D794,759 | S | 8/2017 | Karnegie et al. |
| D814,611 | S | 4/2018 | Karnegie |
| 9,945,106 | B2 | 4/2018 | Ali et al. |
| 10,106,967 | B2 | 10/2018 | Sebolt |
| 10,501,917 | B2 | 12/2019 | Ali et al. |
| 2004/0216367 | A1 | 11/2004 | Klein |
| 2004/0255378 | A1 | 12/2004 | Tracy |
| 2006/0248637 | A1 | 11/2006 | Pan |
| 2008/0244825 | A1 | 10/2008 | Delmonico |
| 2008/0282466 | A1 | 11/2008 | Swan |
| 2009/0172870 | A1 | 7/2009 | Hong |
| 2010/0000011 | A1 | 1/2010 | Angarita |
| 2010/0071122 | A1 | 3/2010 | Li |
| 2010/0138985 | A1 | 6/2010 | Duncan |
| 2010/0205734 | A1 | 8/2010 | Peterson |
| 2011/0000014 | A1 | 1/2011 | Ball et al. |
| 2011/0126347 | A1 | 6/2011 | Qian et al. |
| 2011/0185494 | A1 | 8/2011 | Beck et al. |
| 2013/0125299 | A1 | 5/2013 | Tong |
| 2013/0185855 | A1 | 7/2013 | Ali et al. |
| 2014/0007334 | A1 | 1/2014 | Golibart |
| 2014/0115777 | A1 | 5/2014 | Schulze |
| 2014/0173819 | A1 | 6/2014 | Ali et al. |
| 2016/0251839 | A1 | 9/2016 | Ali |
| 2017/0030060 | A1 | 2/2017 | Ali et al. |
| 2018/0274218 | A1* | 9/2018 | Karnegie ..... E03C 1/262 |
| 2019/0017255 | A1 | 1/2019 | Ali et al. |

FOREIGN PATENT DOCUMENTS

| | | | |
|---|---|---|---|
| CN | 104285017 | A | 1/2015 |
| DE | 9 413 621 | U1 | 11/1994 |
| DE | 201 03 271 | U1 | 6/2001 |
| EP | 2 807 309 | B1 | 4/2020 |
| JP | 2008-25276 | A | 2/2008 |
| KR | 20-0403195 | Y1 | 12/2005 |
| KR | 10-2010-0065614 | A | 6/2010 |
| KR | 10-1008046 | B1 | 1/2011 |
| RU | 2 615 490 | C2 | 4/2017 |
| WO | 2013/112385 | A1 | 8/2013 |
| WO | 2020/097207 | A1 | 5/2020 |

* cited by examiner

DRAIN STRAINER

BACKGROUND

Technical Field

The present disclosure relates to a stopper assembly for a drain system of a fluid basin, and in particular, a stopper assembly with a strainer element.

Description of the Related Art

Conventional bathroom sinks typically include a stopper that serves to selectively seal or open a drain in a sink basin. The stopper is mounted to the top of a plunger seated in a drain pipe that extends below the sink basin. The stopper can be moved between open and closed positions by actuating a lever located near the sink faucet. The lever is typically mechanically linked to a horizontal rod that extends below the sink and transmits motion imparted on the lever to the plunger. The horizontal rod typically extends through a pivot seat in the drain pipe to achieve the desired lifting and lowering motion of the plunger. By actuating the lever, a user is able to raise and lower the stopper, and thereby select whether to open or close the sink drain.

The conventional drain and stopper mechanisms described above, however, can be problematic. For example, the horizontal rod tends to become misaligned relative to the plunger or the lever after a relatively short period of use, resulting in the stopper sagging or tilting in the open position or failing to close properly. In addition, hair and foreign objects that pass through the drain can clog up the sink, making it necessary to either disassemble the pipes located beneath the sink in order to unclog the drain, or to call a plumber. There is also a risk that valuable items, such as rings and contact lenses, can fall into the sink drain and potentially be lost. It is known to include a strainer beneath a stopper in a bathroom sink, tub or other fluid basin. However, conventional strainer assemblies for bathroom sinks, tubs or other fluid basins can be difficult to access for cleaning and replacement.

BRIEF SUMMARY

Embodiments described herein provide systems and methods that enable a strainer cartridge to be installed in a drain of a fluid basin and selectively replaced or cleaned as desired in a particularly efficient manner. Systems of the present disclosure include, for example, a removable strainer cartridge having a telescopic strainer assembly including an upper strainer portion and a lower strainer portion in telescopic engagement with each other. In some instances, the telescopic strainer assembly may be easily and conveniently be moved from a compressed position to seal the drain of the fluid basin and may be easily and conveniently moved from the compressed position to an expanded position to drain the fluid basin of fluid through the drain. The strainer cartridge may be removed from the drain to clean the telescopic strainer assembly when the telescopic strainer assembly is full of collected debris or is to be replaced by a new strainer assembly. In some, embodiments the strainer cartridge may be installed in a simple drop-in or clip-in manner through clip arrangements extending from a lower end of the lower strainer portion. Embodiments provide straining functionality in addition to drain stopper functionality.

DETAILED DESCRIPTION

Figure 1A:
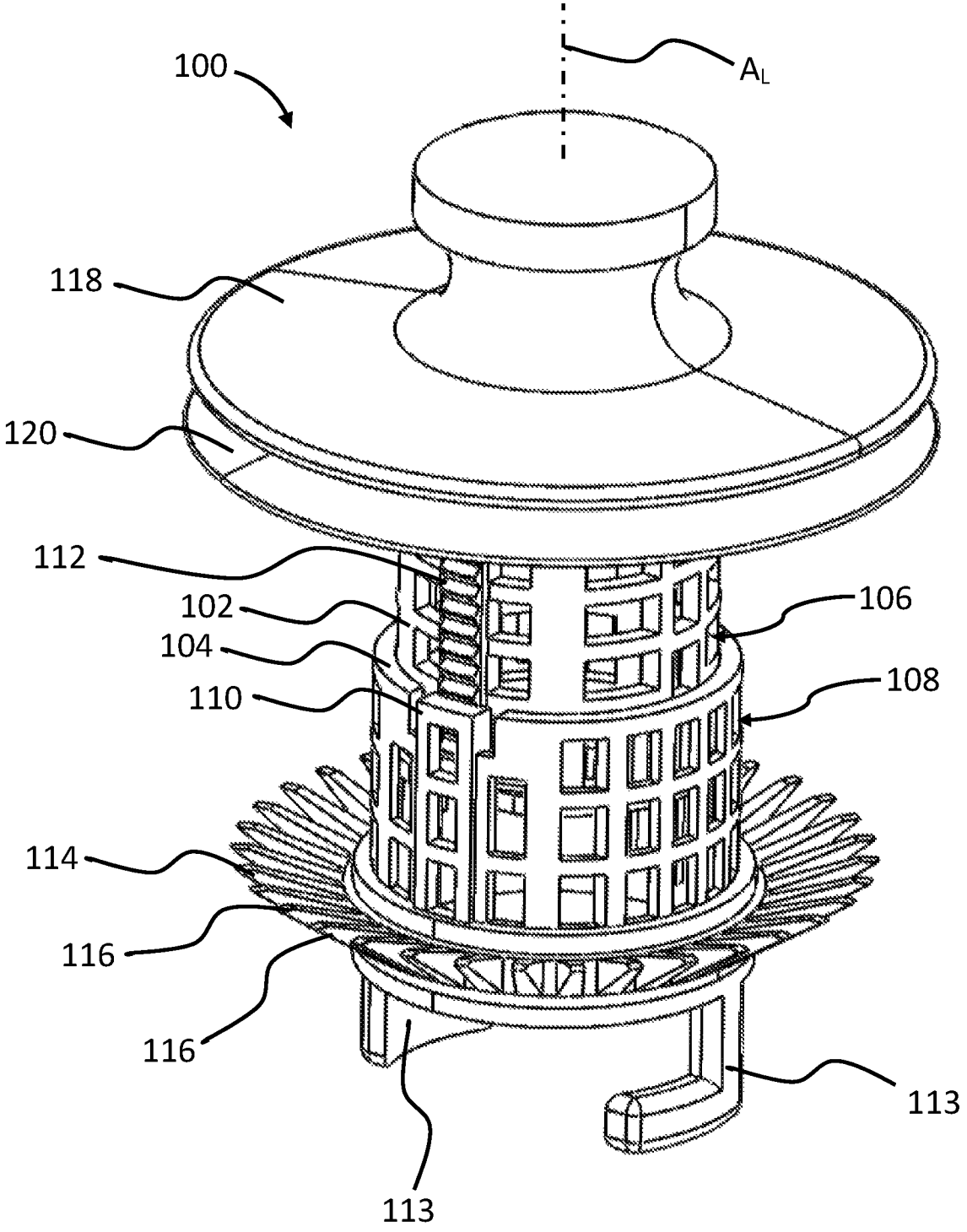
FIG. 1A is a perspective view of a strainer cartridge, according to an example embodiment of the present disclosure.

In the following description, certain specific details are set forth in order to provide a thorough understanding of various disclosed embodiments. However, one of ordinary skill in the relevant art will recognize that embodiments may be practiced without one or more of these specific details. In other instances, well-known features or structures associated with fluid basins, drain systems, drain stoppers and strainers may not be shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

The present disclosure is directed to a strainer cartridge to be removably inserted into a drain of a fluid basin. The strainer cartridge may be conveniently moved from a compressed position to an expanded position and vice versa by a user either pulling upward or pushing downward on a stopper head of the strainer cartridge. This convenient movement and ease of actuation of the strainer cartridge allows a user to quickly and easily seal the drain by pushing the stopper head down to seal a drain opening of the drain with a gasket of the strainer cartridge. Alternatively, the strainer cartridge may be moved from the compressed position to the expanded position quickly and easily opening the drain opening by simply pulling upward on the stopper head in an upward direction. The strainer cartridge may include an upper strainer portion, a lower strainer portion, and a lateral strainer portion that strain fluid that passes through the upper, lower, and lateral strainer portions, respectively. This straining of the fluid by the strainer portions of the strainer cartridge reduces the likelihood of valuable objects such as rings, jewelry, a contact lenses, or some other type of object from becoming lost by passing through the drain opening into a drain pipe in fluid communication with the drain.

The strainer cartridge of the present disclosure may further include clip arrangements that mechanically engage with a grate structure at a bottom of the drain such that the strainer cartridge may be easily inserted into and removed from the drain. For example, the strainer cartridge may be easily and conveniently inserted into the drain by inserting the clip arrangements through openings in the grate structure and then rotating the strainer cartridge in a clockwise direction interlocking the clip arrangements with the grate structure such that the strainer cartridge held in a stationary position within the drain by the clip arrangements. Alternatively, the strainer cartridge may be easily and conveniently removed from the drain by rotating the strainer cartridge in a counterclockwise direction disengaging the clip arrangements with the grate structure and pulling the clip arrangements through the openings in the grate structure to remove the strainer cartridge from the drain. This ease and convenience of insertion and removal of the strainer cartridge into and out of the drain provides ease and convenience of cleaning of the strainer cartridge or replacing the strainer assembly of the strainer cartridge with a new strainer assembly.

FIGS. 1A-1F show a strainer or stopper cartridge 100 for a drain system of a fluid basin according to one example embodiment. The strainer cartridge 100 is configured to be installed in a drain of a drain system of a fluid basin (e.g., sink basin, tub basin, shower basin, or some other type of basin having a drain or drain system). As will be readily appreciated from the following discussion within the present disclosure, the strainer cartridge 100 is moveable between an expanded position (e.g., drain, draining, or unplugged position) and a compressed position (e.g., sealed or plugged position). In the expanded, unplugged or drain position, fluid (e.g., water or some other type of liquid) may drain out of the fluid basin via the drain system. For example, the drain system may include a drain pipe that extends below the fluid basin and that includes an upper portion having a flange that is received within a drain opening of the fluid basin. In the compressed, sealed, or plugged position, fluid is held and collected within the fluid basin via the strainer cartridge 100 blocking the fluid from draining out of the fluid basin via the drain system as the drain system is sealed off by the strainer cartridge 100.

An upper strainer portion 102 and a lower strainer portion 104 are telescopically engaged with each other. The upper strainer portion 102 is telescopically engaged with the lower strainer portion 104 such that upper strainer portion 102 may readily be moved telescopically into and out of the lower strainer portion 104. When the upper strainer portion 102 is telescopically moved into the lower strainer portion 104, the strainer cartridge 100 is moved away from the expanded position and moved towards the compressed position. Alternatively, when the upper strainer portion 102 is telescopically moved outward from the lower strainer portion 104, the strainer cartridge 100 is moved away from the compressed position and moved towards the expanded position. When the upper strainer portion 102 is moved into the lower strainer portion 104, the upper strainer portion 102 is moved in a downward direction, and, alternatively, when the upper strainer portion 102 is moved outward from the lower strainer portion 104, the upper strainer portion 102 is moved in an upward direction.

The upper and lower strainer portions 102, 104, respectively, each have a cylindrical three-dimensional shape. The upper strainer portion 102 has an outer diameter (OD) and an inside diameter (ID). The lower strainer portion 104 has an outer diameter (OD) and an inside diameter (ID). The inside diameter (ID) of the lower strainer portion 104 is slightly larger or equal to the outer diameter of the upper strainer portion 102. The inside diameter of the lower strainer portion 104 being slightly greater than or equal to the outer diameter of the upper strainer portion 102 provides for the upper strainer portion 102 to be telescopically moved into (e.g., inserted) the lower strainer portion 104 and telescopically moved outward from the lower strainer portion 104. The outer diameter of the lower strainer portion 104 is greater than the outer diameter of the upper strainer portion 102, although in other embodiments the relative sizing may be reversed.

The upper strainer portion 102 includes a plurality of first apertures 106 extending entirely through sidewalls of the upper strainer portion 102 to form a grate structure. The lower strainer portion 104 includes a plurality of second apertures 108 extending entirely through sidewalls of the lower strainer portion 104 to form a grate structure. The grate structures formed by the pluralities of the first and second apertures 106, 108, respectively, strain fluid that passes through the upper and lower portions 102, 104, respectively, through the pluralities of first and second apertures 106, 108. The first and second apertures 106, 108 may be referred to as strainer openings, strainer apertures, strainer holes, or some other type of aperture that extends through the upper and lower strainer portions 102, 104 to strain fluid.

The plurality of first apertures 106 may include first ones having a first shape and size and second ones having a second shape and size different from the first ones of the plurality of first apertures 106. The plurality of second apertures 108 may include first ones having a first shape and size and second ones having a second shape and size different from the first ones of the plurality of second apertures 106. For example, some of the plurality of first apertures 106 may be larger than other ones of the plurality of first apertures 106, and some of the plurality of second apertures 108 may be larger than other ones of the plurality of second apertures 108. The different sized and shaped apertures of the pluralities of first and second apertures 106, 108 may reduce the likelihood of the strainer cartridge 100 becoming clogged resulting in a slower flow of fluid through the strainer cartridge 100 when fluid is flowing out of a fluid basin via a drain system (e.g., drain opening and drain pipe) and is being strained by the strainer cartridge 100 that is positioned within the drain system.

The lower strainer portion 104 further includes one or more elastically deformable cantilever arm 110 that mechanically cooperates with ribs of a ribbed portion 112 of the upper strainer portion 104. The ribs of the ribbed portion 112 may be referred to as bosses, protrusions, detents, or some other type of portion that extends outward from the ribbed portion 112. The ribbed portion 112 may be referred to as a ribbed surface or region, a boss portion, surface or region, a protrusion portion, surface, or region, or some other type of reference to a portion, surface, or region including a ribs, bosses, detents or protrusions that extend therefrom. Some of the plurality of second openings 108 extend through the one or more elastically deformable cantilever arm 110. The cantilever arm 110 slidably interlocks with the ribs of the ribbed portion 112 such that the upper portion 102 may be telescopically moved into and out of the lower strainer portion 104 as discussed earlier within the present disclosure. The cantilever arm 110 may be biased inward towards an axis $A_L$ of the strainer cartridge 100. Further details of the mechanical cooperation and interaction of the elastically deformable cantilever arms 110 and the ribs of the ribbed portions 112 will be discussed in further detail with respect to FIGS. 3A-3D of the present disclosure.

The lower strainer portion 104 includes one or more clip arrangements 113 having an L-shape that extend from a bottom end of the lower strainer portion 104. The one or more clip arrangements 113 may interlock with a grate structure of a drain of a drain system such that the strainer cartridge 100 is held in a stationary position relative to the grate structure and the drain. For example, when the strainer cartridge 100 is inserted into a drain, the one or more clip arrangements 113 may be inserted into openings in the grate structure of the drain, and then strainer cartridge 100 is rotated such that horizontal portions of the clip arrangements interlock with the grate structure.

A lateral strainer portion 114 includes a plurality of fingers 116 that extend laterally outward and away from the lower strainer portion 104 and are angled upward towards the upper strainer portion 102. This upward angle of the plurality of fingers 116 of the lateral strainer portion 114 assist in catching objects (e.g., rings, jewelry, a contact for an individual's eye, etc.) as the angle fingers are angled upward in a direction opposite to a flow of fluid that may pass through the plurality of fingers 116. The lateral strainer portion 114 may be formed of an elastically deformable polymer or a semi-flexible elastically deformable polymer. The lateral strainer portion 114 may be detachably coupled to the lower strainer portion 104. The plurality of fingers 116 strains fluid that passes through the lateral strainer portion 114 that may not pass through the plurality of first apertures 106 of the upper strainer portion 102 or the plurality of second apertures 108 of the lower strainer portion 104. The upper strainer portion 102, the lower strainer portion 104, and the lateral strainer portion 114 reduce the likelihood of a ring, a prescription contact lens, or other similar or like valuable item from becoming lost through the drain system through which fluid passes through when exiting a fluid basin (e.g., sink basin, tub basin, shower basin, or some other similar or like type of fluid basin).

The upper strainer portion 102, the lower strainer portion 104, and the lateral strainer portion 114 may be referred to as a telescopic strainer assembly in which the upper strainer portion 102 and the lower strainer portion 104 telescopically and mechanically engage with each other.

A stopper head 118 is mechanically coupled to the upper strainer portion 102. The stopper head 118 may be detachably coupled to the upper strainer portion 102 such that the stopper head 118 may be detached from the upper strainer portion 102. The mechanical coupling of the stopper head 118 to the upper strainer portion 102 will be discussed in further detail with respect to FIG. 1F of the present disclosure.

A gasket 120 is mechanically coupled to the stopper head 118. The gasket 120 may be detachably coupled to the stopper head 118 such that the gasket 120 may be detached from the stopper head 118. The mechanical coupling of the gasket 120 to the stopper head 118 will be discussed in further detail with respect to FIG. 1F of the present disclosure.

The stopper head 118 and the gasket 120 may have circular profiles when viewed in a top plan view and have diameters that are greater than outer diameters of the upper and lower strainer portions 102, 104, respectively. For example, the stopper head 118 and the gasket 120 may have diameters slightly larger than a diameter of a drain opening such that the gasket 120 abuts a flange of a drain of a drain system sealing the drain opening of the drain such that fluid may not readily pass through the drain to exit a fluid basin when the strainer cartridge 100 is in the compressed position. The details of the gasket 120 sealing the drain opening of the drain of the drain system will be discussed in further detail with respect to FIGS. 3A-3D of the present disclosure.

The upper and lower strainer portions 102, 104, the lateral strainer portion 114, the stopper head 118, and the gasket 120 may be concentric along an axis $A_L$. For example, the upper and lower strainer portions 102, 104, the lateral strainer portion 114, the stopper head 118, and the gasket 120 may all have centers that are aligned with and along the axis $A_L$, which may be referred to as a central axis, a center axis, or some other type of axis that extends through these respective centers. The fingers 116 of the lateral strainer portion 114 extend away from and outward from the axis $A_L$.

Figure 1B:
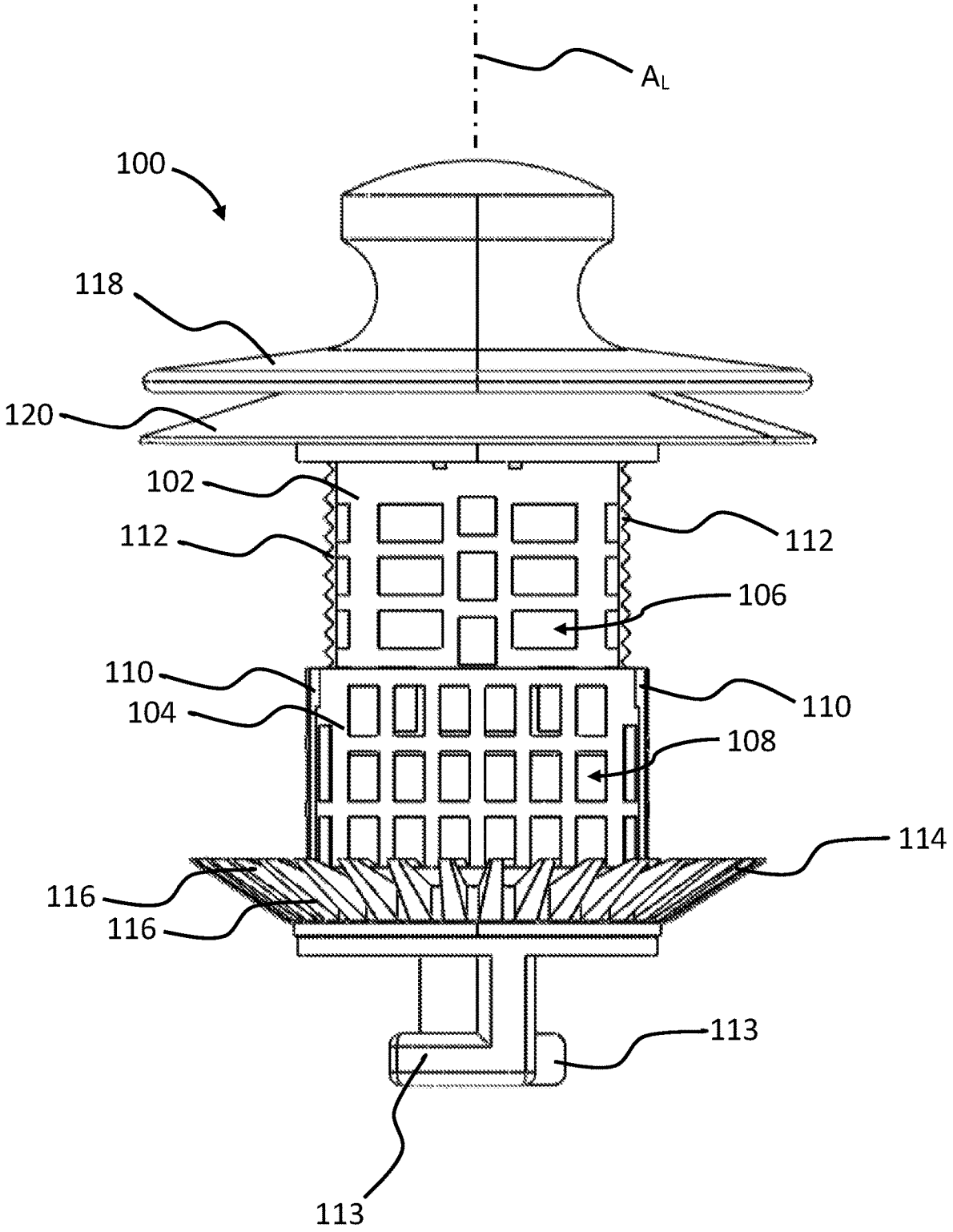
FIG. 1B is a side view of the strainer cartridge as shown in FIG. 1A.

FIG. 1B is a side view of the strainer cartridge 100 as shown in FIG. 1A. As may more readily be seen in FIG. 1B, in this embodiment, the lower strainer portion 104 of the strainer cartridge 100 includes two elastically deformable cantilever arms 110 on opposite sides of the strainer cartridge 100. In this embodiment, the upper strainer portion 102 of the strainer cartridge 100 includes two ribbed portions 112. The ribbed portion 112 at the left-hand side of the upper strainer portion 102 mechanically cooperates and engages with the cantilever arm 110 at the left-hand side of the lower strainer portion 104. The ribbed portion 112 at the right-hand side of the upper strainer portion 102 mechanically cooperates and engages with the cantilever arm 110 at the right-hand side of the lower strainer portion 104.

The ribs of the ribbed portion 112 protrude outward from an outer sidewall surface of the upper strainer portion 102. The ribbed portion 112 extend from a lower end of the upper strainer portion 102 to an upper end of the upper strainer portion 102 opposite to the lower end of the upper strainer portion 102.

Figure 1C:
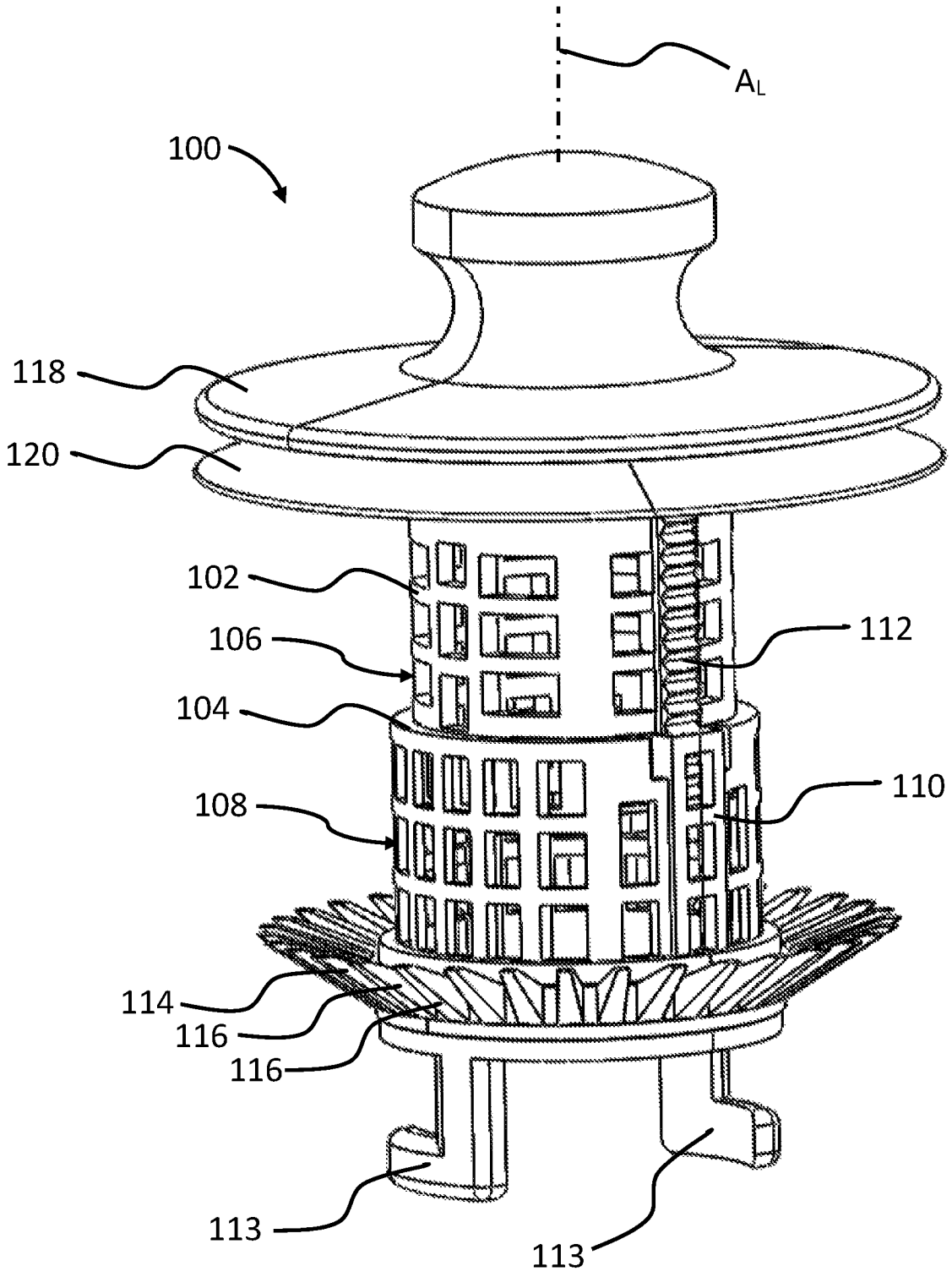
FIG. 1C is a perspective view of the strainer cartridge as shown in FIGS. 1A and 1B.

FIG. 1C is a perspective view of the strainer cartridge of an opposite side of the strainer cartridge 100 than the strainer cartridge 100 as shown in FIG. 1A. The cantilever arm 110 and the ribbed portion 112 at the right-hand side of the strainer cartridge 100 as shown in FIG. 1B may more readily seen in FIG. 1C. As may readily be seen, ones of the plurality of second openings 108 extend through the elastically deformable cantilever arm 110 at the right-hand side of the strainer cartridge 100 similar to the ones of the plurality of second openings 108 that extend through the elastically deformable cantilever arm 110 at the left-hand side of the strainer cartridge 100.

Figure 1D:
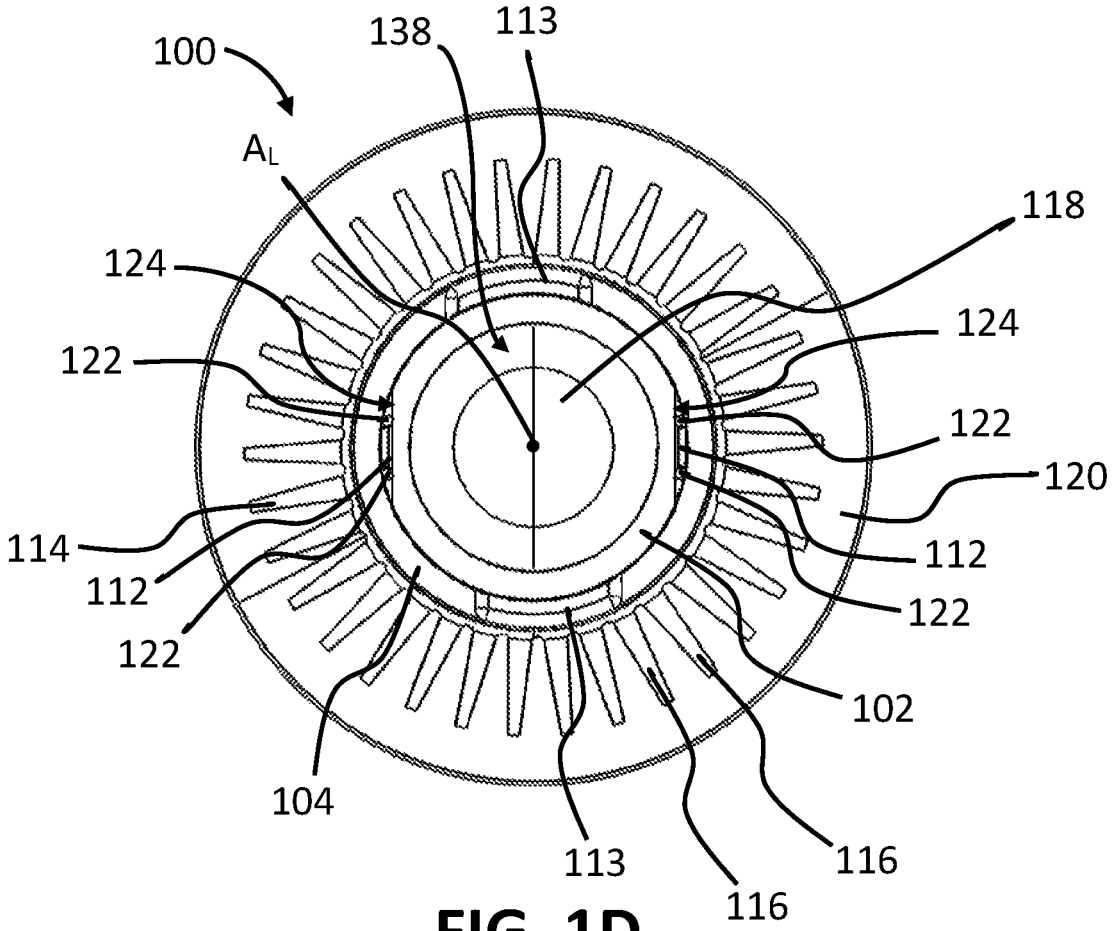
FIG. 1D is a bottom plan view of the strainer cartridge as shown in FIGS. 1A-1C.
Figure 1E:
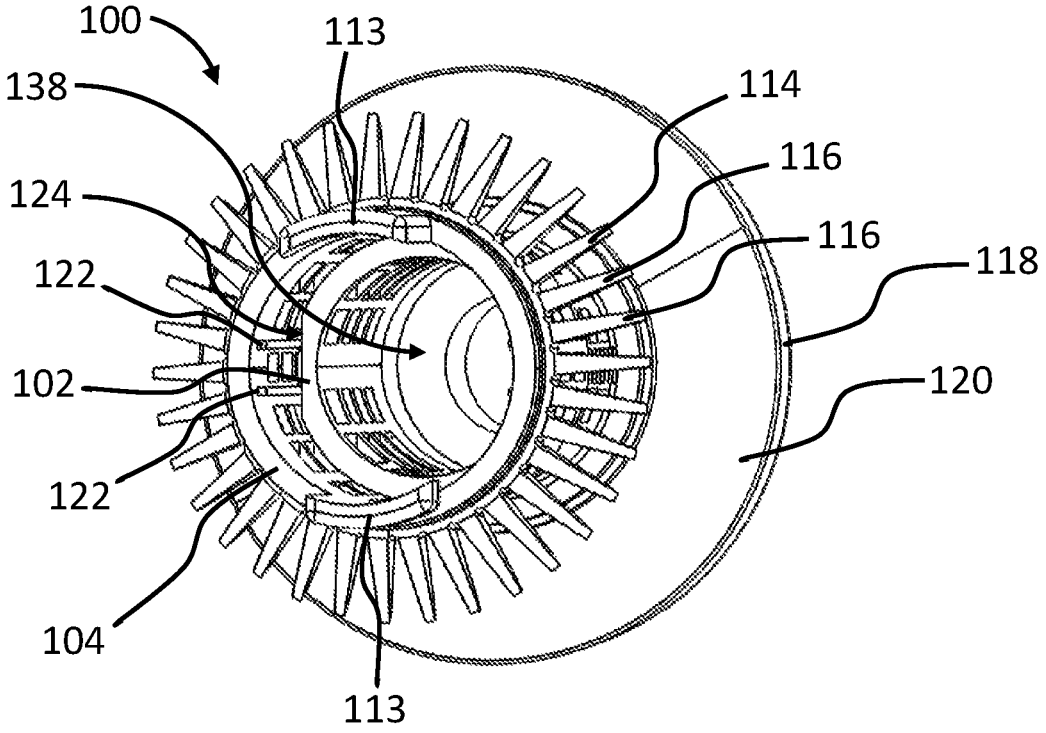
FIG. 1E is a rotated bottom plan view of the strainer cartridge as shown in FIGS. 1A-1D.

FIG. 1D is a bottom plan view of the strainer cartridge 100. As may readily be seen, the upper and lower strainer portions 102, 104 are hollow such that fluid may readily pass through the pluralities of first and second openings 106, 108, respectively, of the upper and lower strainer portions 102, 104, respectively, when draining a fluid basin. Since the upper and lower strainer portions 102, 104, respectively, are hollow, the upper and lower strainer portions 102, 104, respectively, define a void 138 extending entirely through the upper and lower strainer portions 102, 104, respectively. The void 138 extends from the stopper head 118 to a lower or bottom end of the lower strainer portion 104.

The lower strainer portion 104 includes a plurality of anti-rotation structures 122 that protrude outward from an inner sidewall surface of the lower strainer portion 104 towards an outer sidewall surface of the upper strainer portion 102. First ones of the anti-rotation structures 122 are at a first side of the lower strainer portion 104 and second ones of the anti-rotation structures 122 are at a second side of the lower strainer portion 104 opposite to the first side. The anti-rotation structures 122 are aligned with the cantilever arms 110 such that the anti-rotation structure may protrude inward from the cantilever arms 110 towards the axis $A_L$. In other words, the anti-rotation structures 122 are at and protrude from inner surfaces along the cantilever arms 110 and the lower strainer portion 104. The anti-rotation structures 122 face inward and extend inward towards the axis $A_L$.

The upper strainer portion 102 includes one or more anti-rotation surfaces 124 on opposite sides of the upper strainer portion 102. The anti-rotation surfaces 124 may be referred to as outer surface regions, outer surfaces, or some other type of reference to a surface that abuts and engages with ones of the anti-rotation structures 122. The anti-rotation surfaces 124 are relatively flat surfaces as compared to other curved surfaces of the cylindrical upper and lower strainer portions 102, 104, respectively. The anti-rotation surfaces 124 of the upper strainer portion 102 abut and mechanically engage with the anti-rotation structures 122 of the lower strainer portion 104.

As shown in FIG. 1D, two anti-rotation structures 122 of the lower strainer portion 104 at the left-hand side of FIG. 1D abut the anti-rotation surface 124 of the upper strainer portion 102 at the left-hand side of FIG. 1D. As shown in FIG. 1D, two anti-rotation structures 122 of the lower strainer portion 104 at the right-hand side of FIG. 1D abut the anti-rotation surface 124 of the upper strainer portion 102 at the right-hand side of FIG. 1D. The following discussion will focus on the two anti-rotation structures 122 and the anti-rotation surface 124 at the left-hand side of FIG. 1D. However, it will be appreciated that the following discussion readily applies to the anti-rotation structures 122 and the anti-rotation surface 124 at the right-hand side of FIG. 1D. The two anti-rotation structures 122 and the anti-rotation surface 124 at the left-hand side of FIG. 1D may more readily be seen in FIG. 1E, which is a bottom plan rotated view of the strainer cartridge 100.

The two anti-rotation structures 122 are spaced apart such that the ribs of the ribbed portion 122 at the left-hand side of upper strainer portion 102 may pass between the two anti-rotation structures 122 when the upper strainer portion 102 is telescopically moved into and out of the lower strainer portion 104. If a torque (e.g., clockwise or counterclockwise) is applied to the upper strainer portion 102, the upper strainer portion does not rotate relative to the lower strainer portion such that the ribs of the ribbed portions 112 remain aligned with the cantilever arm 110 and remain in mechanical cooperation and engagement with the cantilever arm 110. For example, if a torque (e.g., clockwise or counterclockwise) is applied to the upper strainer portion 102, the anti-rotation surface 124 abuts against at least one of the two anti-rotation structures 122 and at least one of the ribs protruding from the ribbed portion 112 abuts against at least a sidewall surface of at least one of the two anti-rotation structures 122. This mechanical abutting of these various portions and surfaces of the upper strainer portion 102 and the lower strainer portion 104 opposes the rotation of the upper strainer portion 102 relative to the lower strainer portion 104 such that the upper and lower strainer portions 102, 104, respectively, remain appropriately positioned and aligned relative to each other. This appropriate alignment being maintained results in the ribbed portion 112 remaining aligned with and in mechanical cooperation and engagement with the cantilever arm 110. In other words, the anti-rotation structures 122, the anti-rotation surfaces 120, and the ribs of the ribbed portions 112 reduce the likelihood of misalignment between the upper and lower strainer portions 102, 104, respectively, such that the telescopic mechanical engagement and cooperation between the upper and lower strainer portions 102, 104, respectively, is maintained even when the strainer cartridge 100 is exposed to a torque (e.g., clockwise or counterclockwise).

Figure 1F:
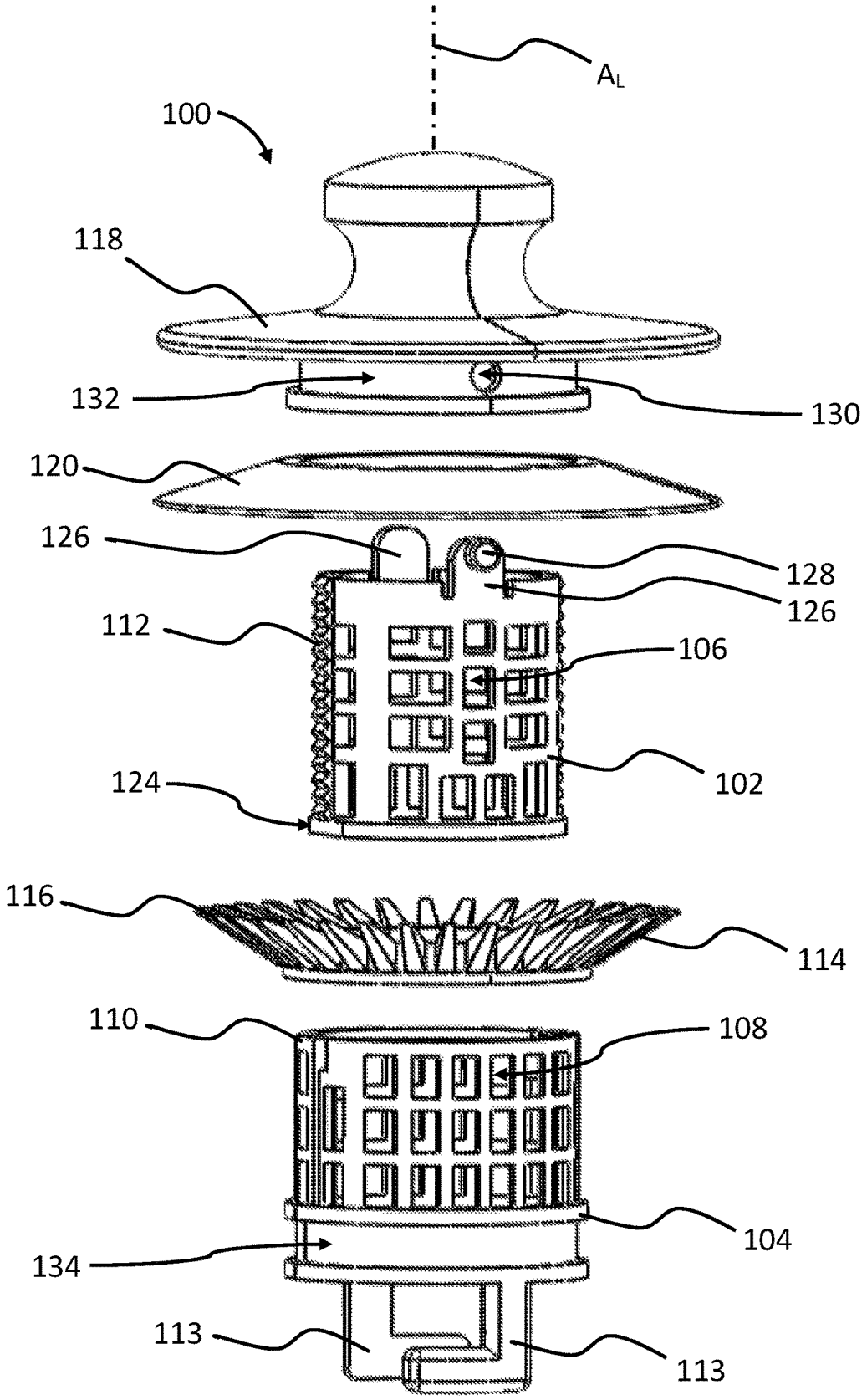
FIG. 1F is an exploded view of the strainer cartridge as shown in FIG. 1A-1E.

FIG. 1F is an exploded view of the strainer cartridge 100 as shown in FIGS. 1A-1E. As may more readily be seen in FIG. 1F, the strainer cartridge 100 includes the upper, lower, and lateral strainer portions 102, 104, 114, the stopper head 118, and the gasket 120.

As shown in FIG. 1F, the upper strainer portion 102 includes one or more elastically deformable tabs or tab portions 126 that extend outward from the upper end of the upper strainer portion 102. One or more protrusions 128 extend outward from corresponding ones of the tabs 126 in a direction transverse to a direction from which the tabs 126 extend from the upper end of the upper strainer portion 102. The protrusions 126 are inserted into one or more holes 130 extending through a sidewall surface of the stopper head 118. The protrusions 126 and the holes 130 mechanically and detachably couple the upper strainer portion 102 to the stopper head 118 by bending the elastically deformable tabs 126 inward towards the axis $A_L$ and pushing the tabs 126 into the stopper head 118 until the protrusions 128 are aligned with corresponding ones of the holes 130. Once the protrusions 128 are aligned with corresponding ones of the holes 130, the tabs 128 snap outward away from the axis $A_L$ snapping and inserting the protrusions 126 (e.g., snap fit) into corresponding ones of the holes 130 in the stopper head 118. The upper strainer portion 102 may be detached or decoupled from the stopper head by pushing the protrusions 128 inward through the holes 130 deforming the tabs 126 inward toward the axis $A_L$ and pulling on the upper strainer portion 102 decoupling the upper strainer portion 102 from the stopper head 130. The tabs or tab portions 126 may be biased outward and away from the axis $A_L$ of the strainer cartridge 100.

The upper strainer portion 102 may be removed from the lower strainer portion 104. For example, the upper strainer portion 102 may be removed by pulling upward enough on the upper strainer portion 102 until the upper strainer portion is removed from the lower strainer portion 104. The upper strainer portion 102 may be removed from the lower strainer portion 104 to clean or rinse the upper and lower strainer portions 102, 104, respectively.

In some embodiments, the holes 130 may be replaced by indentations extending into an inner sidewall surface of the stopper head 118. However, unlike the holes 130 as shown in FIG. 1F, the indentations do not extend entirely through the stopper head 118 and instead terminate before extending entirely through the stopper head 118. When the holes 130 are replaced by indentations, the tabs or tab portions 126 may be elastically deformed to remove the upper strainer portion from the stopper head by pushing on the tab or tab portions 126 instead of pushing on the protrusion 128.

As shown in FIG. 1F, the stopper head 118 further includes a first circumferential channel 132 that receives the gasket 120 such that the gasket 120 is detachably coupled to the stopper head 118. For example, when the gasket is formed of an elastically deformable polymer, the gasket 120 may be removed from the stopper head 118 by pulling on the gasket 120 such that enough force is applied to elastically deform the gasket 120 such that the gasket 120 may be removed from the first circumferential channel 132. In some embodiments, the gasket 120 may be made of an elastically deformable polymer or a semi-flexible elastically deformable polymer. The first circumferential channel 132 overlaps the holes 130. The gasket 120 is circumferentially around the stopper head 118.

The lower strainer portion 104 includes a second circumferential channel 134 that receives the lateral strainer portion 114 such that the lateral strainer portion 114 is mechanically coupled to the lower strainer portion 104. In some embodiments, the lateral strainer portion 114 may be made of an elastically deformable polymer or a semi-flexile elastically deformable polymer. In some embodiments, the lateral strainer portion 114 may be integral the lower strainer portion 104. For example, both the lateral strainer portion 114 and the lower strainer portion 104 may be made of a relatively rigid polymer material (e.g., plastic) such that both are formed at the same time and as a single unitary and integral piece of the relatively rigid polymer material by utilizing an injection molding process. The lateral strainer portion 114 is circumferentially around the lower strainer portion 104.

The anti-rotation surfaces 124 are at the lower end of the upper strainer portion 102 and are at bottom ends of corresponding ones of the ribbed portions 112. As discussed earlier, the anti-rotation surfaces 124 abut corresponding ones of the anti-rotation structures 122 to avoid rotation of the upper strainer portion 102 relative to the lower strainer portion 104. The positioning of the anti-rotation surfaces 124 may more readily be seen in FIG. 4B.

Figure 2A:
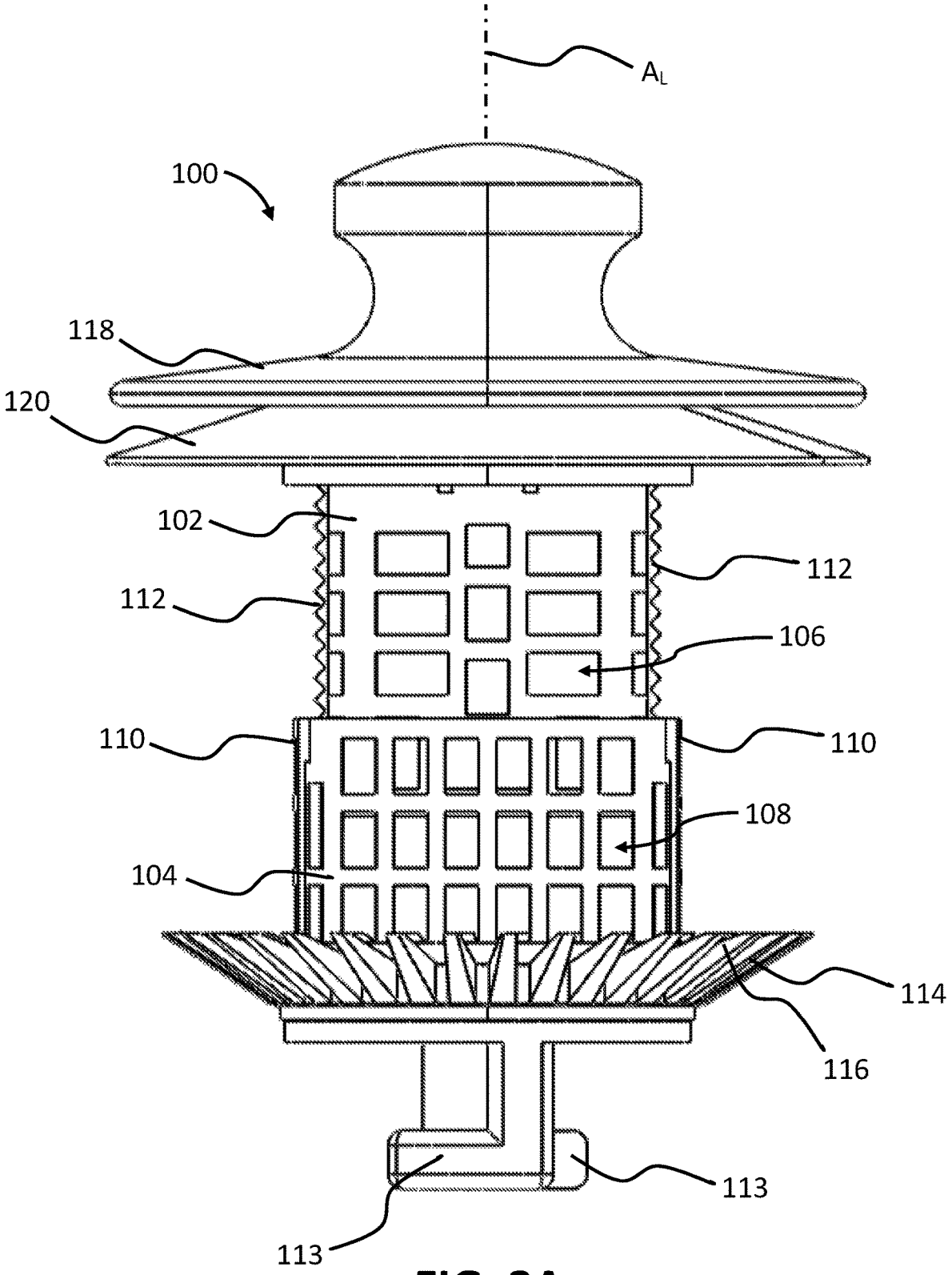
FIG. 2A is a side view of the strainer cartridge as shown in FIGS. 1A-1F when the strainer cartridge is in an expanded (e.g., drain) position.

FIG. 2A is a side view of the strainer cartridge 100. As shown in FIG. 2A, the strainer cartridge 100 is in the expanded position (e.g., drain position, draining position, etc.) in which the upper strainer portion 102 is fully extended outward from the lower strainer portion 104.

Figure 2B:
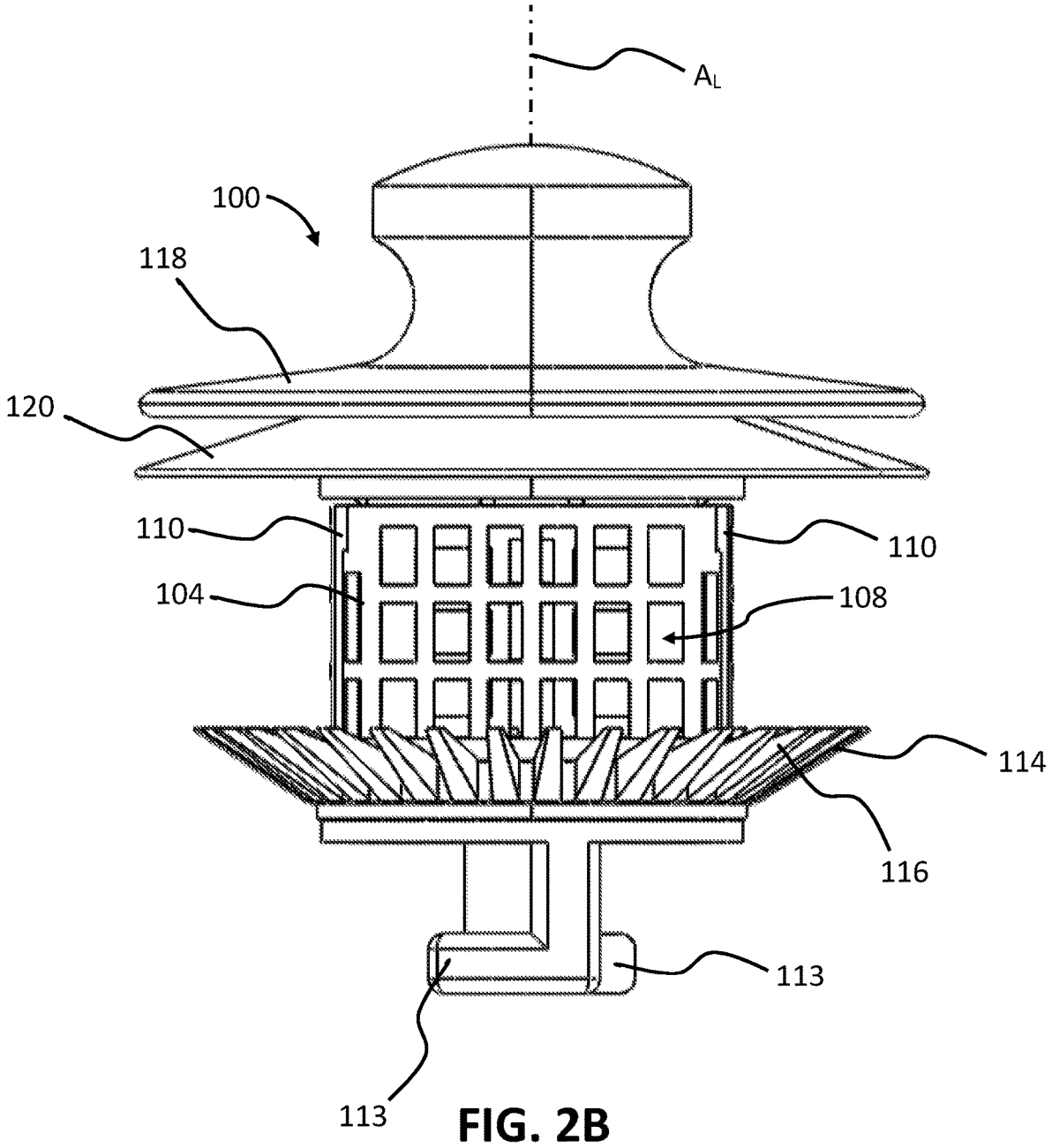
FIG. 2B is a side view of the strainer cartridge as shown in FIGS. 1A-1F when the strainer cartridge is in a compressed (e.g., plug) position.

FIG. 2B is a side view of the strainer cartridge 100 when the strainer cartridge 100 is in the compressed position (e.g., plug position, plugged position, etc.) in which the upper strainer portion 102 is fully compressed such that the upper strainer portion 102 is fully or mostly inset within the lower strainer portion 104. For example, when the upper strainer portion 102 is inset within the lower strainer portion 104, fluid may be blocked off from exiting a fluid basin through a drain opening of a drain of a drain system in fluid communication with the fluid basin as the drain opening is sealed off by the gasket 120 of the strainer cartridge 100.

Figure 3A:
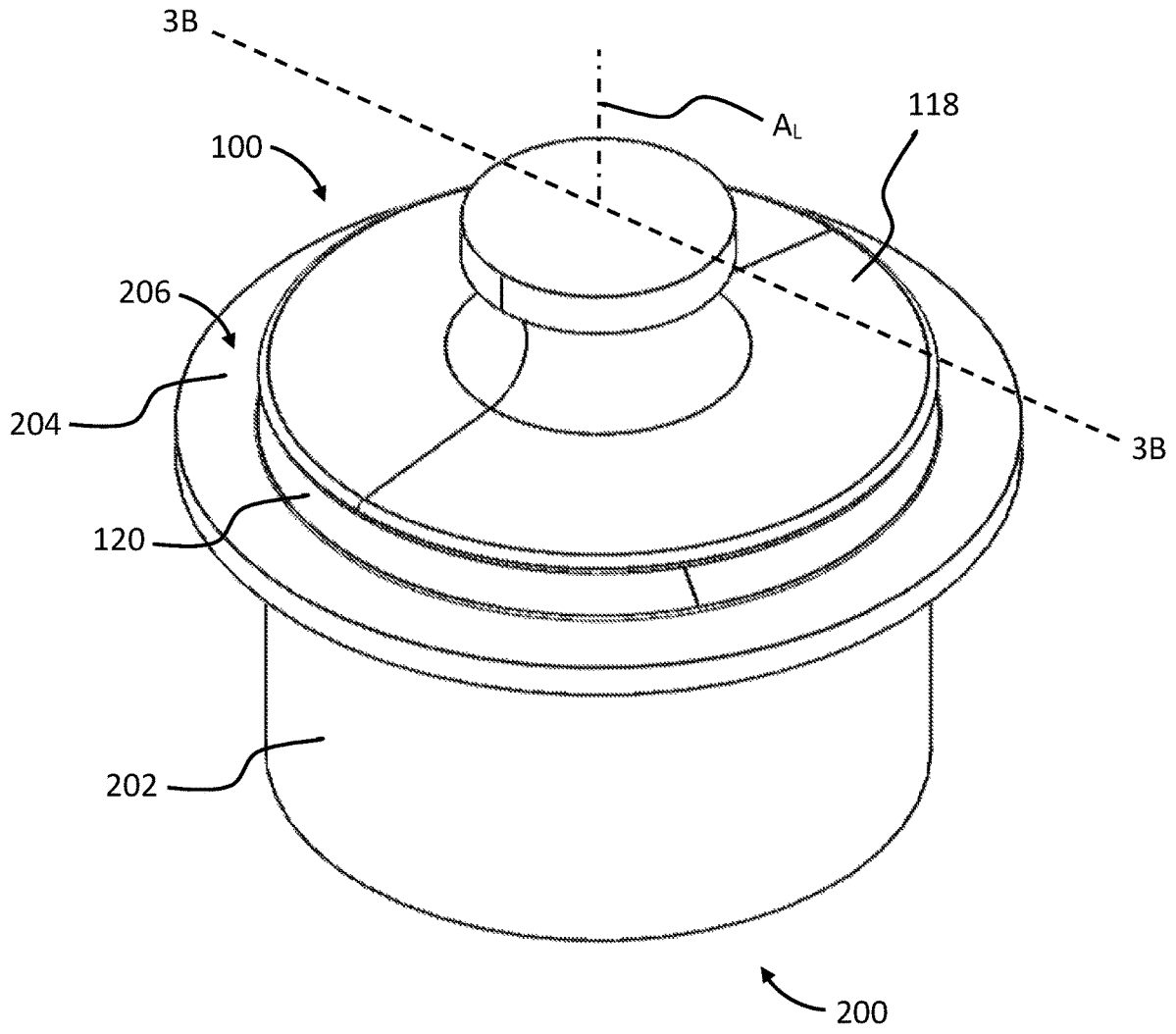
FIG. 3A is a perspective view of the strainer cartridge as shown in FIGS. 1A-1F in a drain of a drain system of a fluid basin when the strainer cartridge is in the compressed position.

FIG. 3A shows a drain system 200 including the strainer cartridge 100 and a drain body 202. The strainer cartridge 100 is in the drain body 202. A flange 204 extends laterally outward from the drain body 202 and the flange 204 includes a peripheral region or surface 206 around a drain opening 208, which may more readily be seen in FIG. 3C, of the drain body 202. As shown in FIG. 3A, the strainer cartridge 100 is within a recess 210, which may more readily be seen in FIG. 3C, of the drain body 202 and the strainer cartridge 100 is in the compressed position in which the gasket 120 abuts the peripheral surface 206 of the flange sealing off the drain opening 206 such the fluid may not exit a fluid basin through the drain opening 206 and the recess 210 of the drain body 202.

Figure 3B:
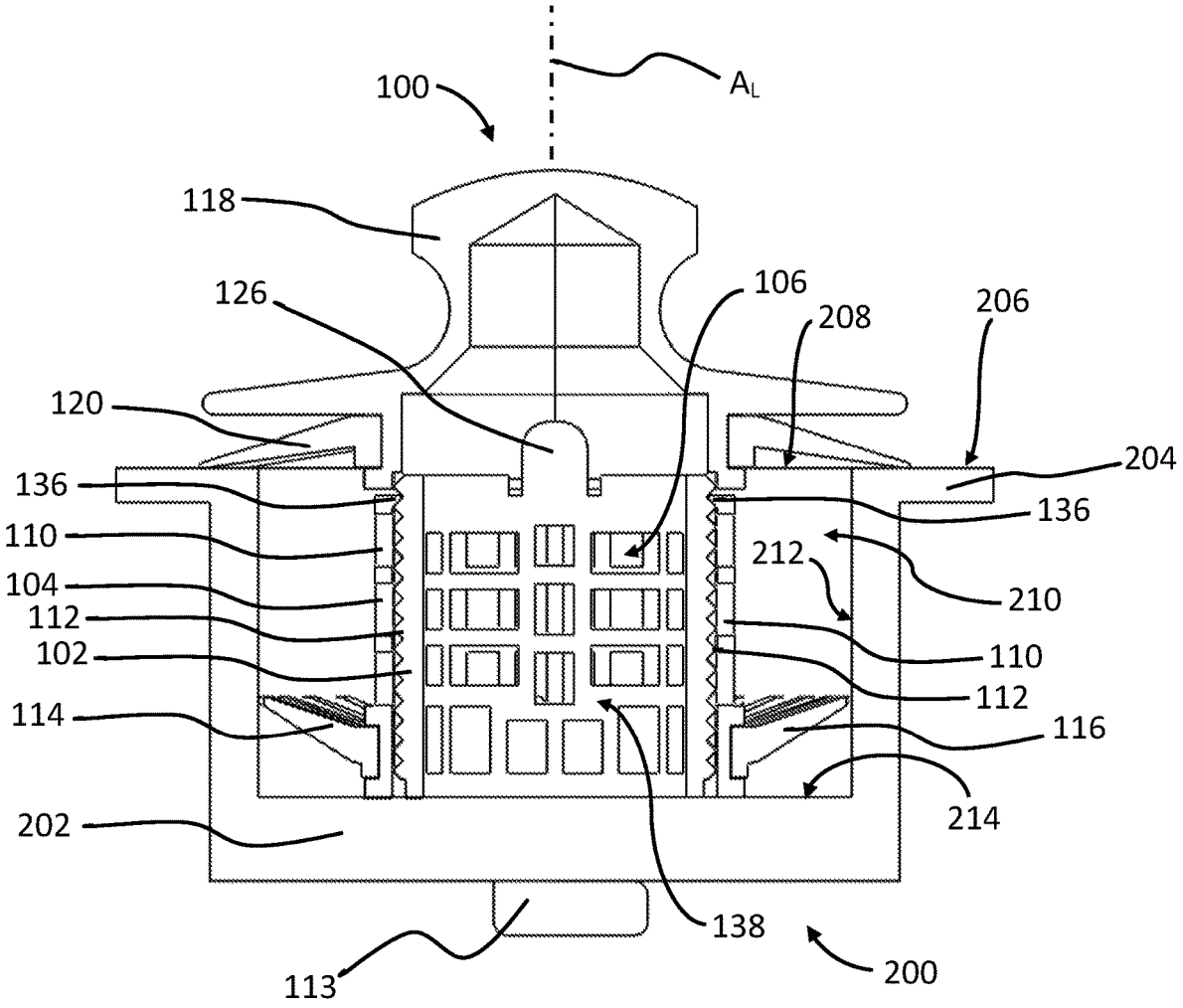
FIG. 3B is a cross-sectional view of the strainer cartridge in the drain as shown in FIG. 3A taken along line 3B-3B as shown in FIG. 3A.

FIG. 3B is a cross-sectional view of the drain system 200 taken along dotted line 3B-3B as shown in FIG. 3A. As may readily be seen in FIG. 3B, the gasket 120 abuts the peripheral surface 208 sealing off the drain opening 208 as discussed earlier with respect to FIG. 3A. As shown in FIG. 3B, the cantilever arms 110 include lip portions 136 that are sized, shaped, and structured to be received between adjacent ones of the ribs of the ribbed portion 112 such that the cantilever arms 110 may temporarily hold the upper strainer portion 102 stationary relative to the lower strainer portion 104. For example, the lip portions 136 are received by a valley between two adjacent ribs along the ribbed portion 112.

As shown in FIG. 3B, in this embodiment, ends of the fingers 116 of the lateral strainer portion 114 extend outward and away from the lower strainer portion 104 to a sidewall surface 212 of the drain body 202. The sidewall surface 212 of the drain body 202 delimits the recess 210 in the drain body 202. The ends of the fingers 116 of the lateral strainer portion 114 terminate proximate to the sidewall surface 212 of the drain body 202. The ends of the fingers 116 may abut the sidewall surface 212 such that the lateral strainer portion 114 acts as a spacer positioning the strainer cartridge 100 within a central region of the recess 210 and such that the lateral strainer portion 114. For example, as the axis $A_L$ extends through the centers of the upper, lower, and lateral strainer portions 102, 104, 114, the stopper head 118, and the gasket 120, the axis $A_L$ may extend through the center and along a central axis of the drain body 202 as well. The strainer cartridge 100 may be concentric with the drain body 202, which is cylindrical similar to the strainer cartridge 100.

In some embodiments, the ends of the fingers 116 may terminate within the recess 210 of the drain body 202 before extending to and reaching the sidewall surface 212 of the drain body 202. In other words, in some embodiments, the ends of the fingers 116 do not abut the sidewall surface 212 delimiting the recess 210 of the drain body 202. In other words, the lateral strainer portion only acts as a strainer and does not act as a spacer when the ends of the fingers terminate within the recess before extending to and reaching the sidewall surface 212 of the drain body 202.

When the upper strainer portion 102 is inset within the lower strainer portion 104 as shown in FIG. 3B, bottom ends or bottom end surfaces of the upper and lower strainer portions 102, 104, respectively, may abut a lower surface 214 of the drain body 202 that delimits the recess 210. Alternatively, as shown in FIG. 3D when the upper strainer portion 102 is extended outward from the lower strainer portion 104, the bottom end of the lower strainer portion 104 may abut the lower surface 214 of the drain body 202 and the bottom end of the upper strainer portion 102 may be spaced apart from the lower surface 214 of the drain body 202.

Figure 3C:
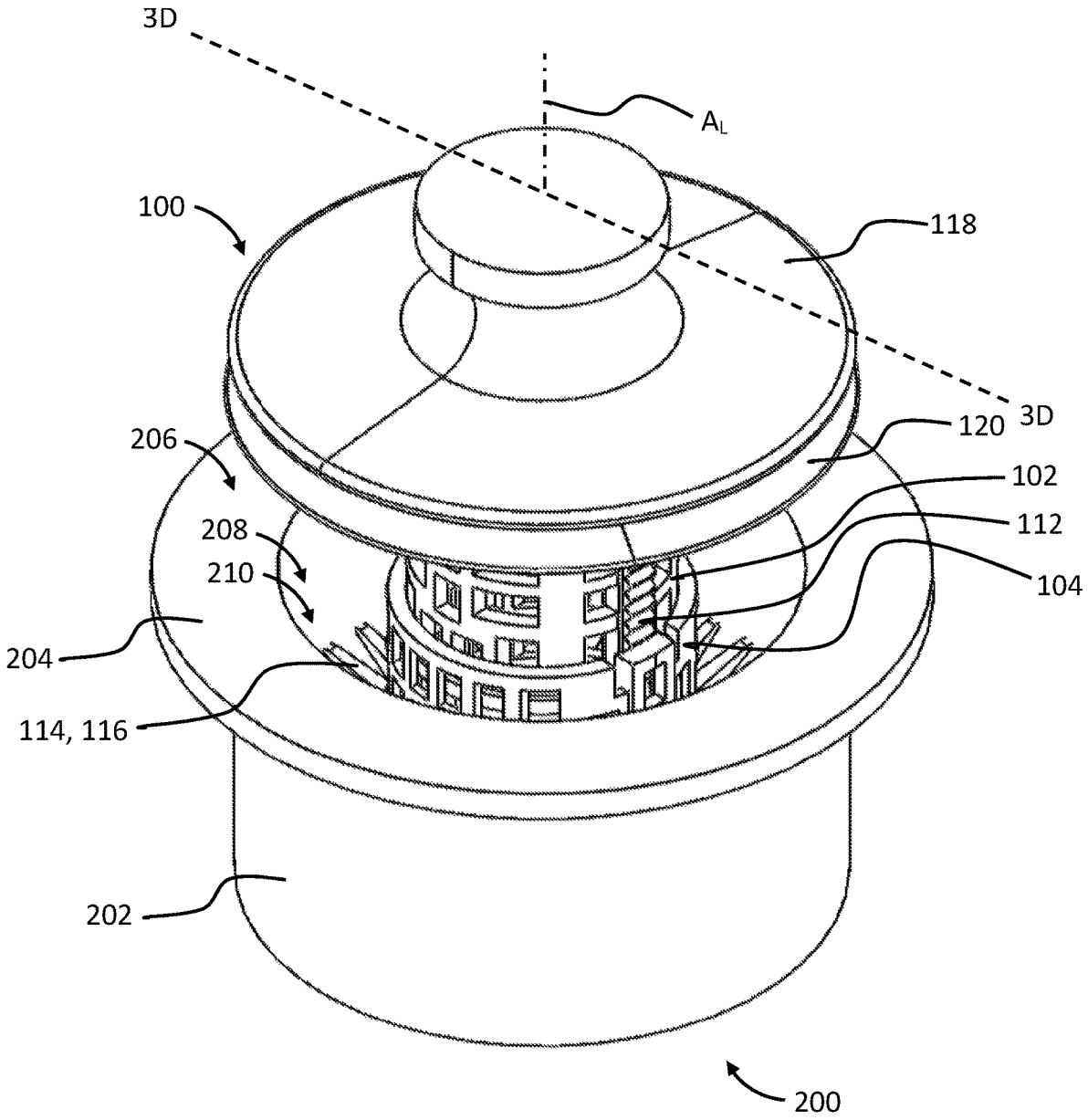
FIG. 3C is a perspective view of the strainer cartridge as shown in FIGS. 1A-1F in the drain of the drain system of the fluid basin when the strainer cartridge is in the expanded position.

FIG. 3C is a perspective view of the drain system 200 in which the strainer cartridge 100 is in the expanded position (e.g., drain position, draining position, etc.) such that fluid may successively pass into and through the drain opening 208 and into and through the recess 210. After passing through the drain opening 208 and through the recess 210 the fluid may continue to pass along a drain pipe (not shown) in fluid communication with the drain body 202. For example, the drain pipe may be a sewage pipe or some other type of pipe through which fluid passes through to exit a fluid basin in fluid communication with the drain body 202.

Figure 3D:
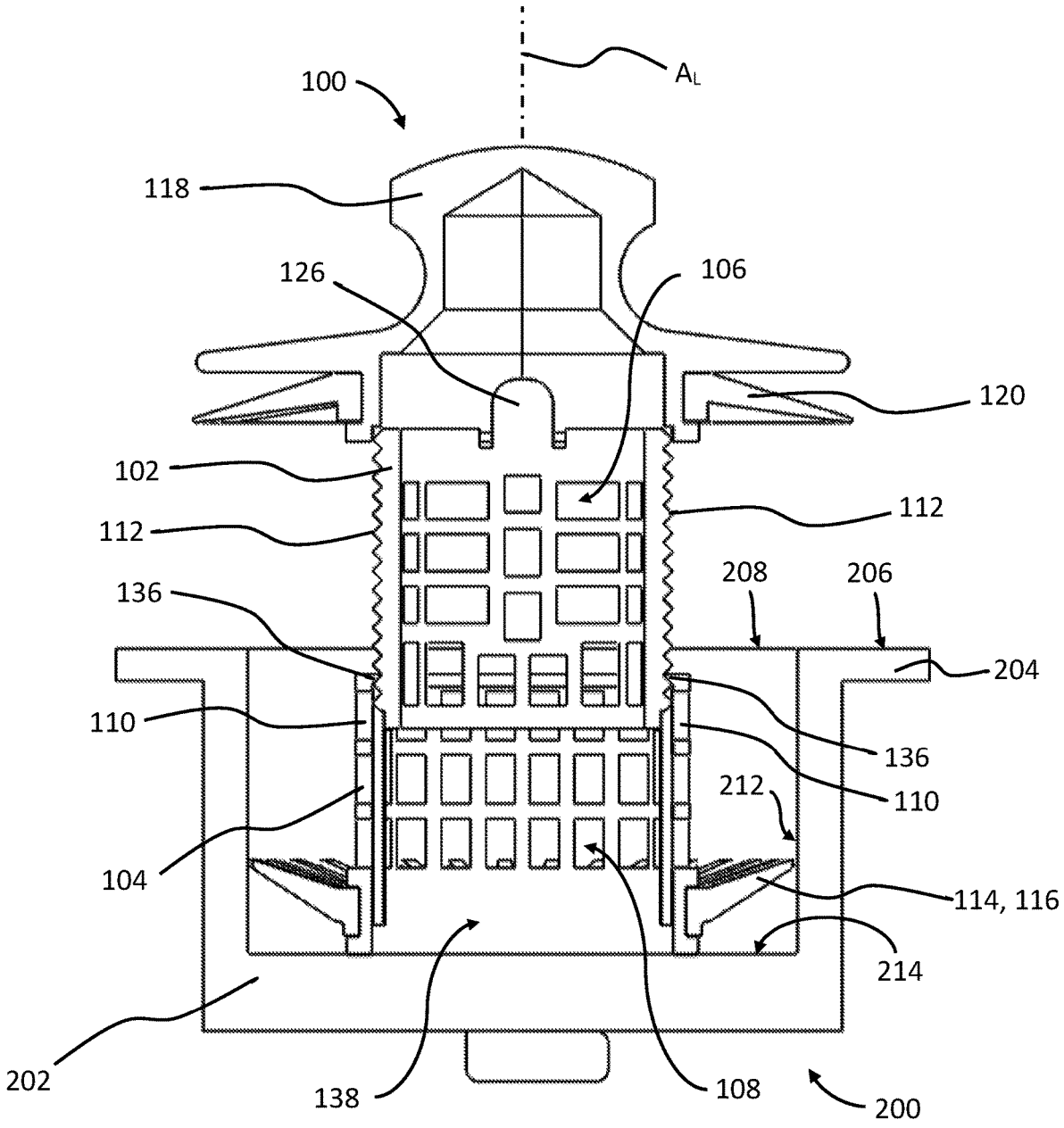
FIG. 3D is a cross-sectional view of the strainer cartridge in the drain as shown in FIG. 3C taken along line 3C-3C as shown in FIG. 3C.

As may readily be seen in FIGS. 3A-3D the upper and lower strainer portions 102, 104, respectively, define and delimit the void 138, which is cylindrical, that extends through and between the upper and lower strainer portion 102, 104, respectively. The void 138 is in fluid communication with the pluralities of first and second openings 106, 108, respectively, of the upper and lower strainer portions 102, 104, respectively, such that fluid may flow through the pluralities of first and second openings 106, 108 into the void 138 to strain the fluid passing through the strainer cartridge. The void 138 may be smaller when the upper strainer portion 102 is inset within the lower strainer portion 104 as shown in FIG. 3B as compared to when the upper strainer portion 102 is in the expanded position and extending from the lower strainer portion 104 as shown in FIG. 3D.

The strainer cartridge 100 may be conveniently moved between the compressed position (e.g., plug position, plugged position, etc.) in which the drain opening 208 is sealed off by the gasket 120 and the expanded position (e.g., drain position, draining position, etc.) in which the drain opening 208 is unimpeded such that fluid may readily pass through the strainer cartridge 100 and the drain opening 208. For example, a user may simply, easily, and conveniently pull upward on the stopper head 118 to mechanically move the upper strainer portion 102 from the compressed position to the expanded position, and, oppositely, the user may simply, easily, and conveniently push downward on the stopper head 118 to mechanically move the upper strainer portion 102 from the expanded position to the compressed position.

When the user pulls on the stopper head 118 moving the upper strainer portion 102 from the compressed position to the expanded position, the cantilever arms 110 successively deflect away from the axis $A_L$ and snap back towards the axis $A_L$ as the lip portions 136 slide and move along angled surfaces, apexes, and valleys of the ribs of the ribbed portions 112. Once the user has moved the upper strainer portion 102 to a selected position, the user ceases pulling on the stopper head 118 and the lip portions 136 are positioned within valleys between adjacent ones of the ribs of the ribbed portions 112 such that the upper strainer portion 102 is held in the expanded position. As the upper strainer portion 102 is moved towards the expanded position, the user may hear a clicking sound or feel tactile feedback based on the mechanical interaction between the lip portions 136 of the cantilever arms 110 and the ribs of the ribbed portions 112.

The size of the void 136 defined by the upper and lower strainer portions 102, 104, respectively, is increased by moving the upper strainer portion 102 from the compressed position to the expanded position. A speed of fluid flow through the drain opening 208, the upper strainer portion 102, and the lower strainer portion 104 may increase as the size of the void 136 increases.

When the user pushes on the stopper head 118 moving the upper strainer portion from the expanded position to the compressed position, the cantilever arms 110 successively deflect away from the axis $A_L$ and snap back towards the axis $A_L$ as the lip portions 136 slide and move along the angled surfaces, the apexes, and the valleys of the ribs of the ribbed portions 112. Once the user has moved the upper strainer portion 102 to a selected position, the user ceases pushing on the stopper head 118. Once the upper strainer portion 102 is in the compressed position, the gasket 120 is contacting the peripheral surface 206 of the flange 204 of the drain body 202 sealing off the drain opening 208 from fluid within a fluid basin. In other words, the gasket 120 and the stopper head 118 stop fluid within the fluid basin from exiting the fluid basin such that the fluid collects within the fluid basin.

The size of the void 136 defined by the upper and lower strainer portions 102, 104, respectively, is decreased by moving the upper strainer portion 102 from the compressed position to the expanded position. A speed of fluid flow through the drain opening 208, the upper strainer portion 102, and the lower strainer portion 104 may decrease as the size of the void 136 decreases. In other words, the upper strainer portion 102 may be positioned in an intermediate position between the fully compressed position and the fully expanded position to limit the speed of the fluid flow through the drain. When the upper strainer portion 102 is in the intermediate position, the upper strainer portion 102 is held stationarily in the intermediate position by the mechanical cooperation and engagement of the cantilever arms 110 and the ribbed portions 112.

Figure 3E:
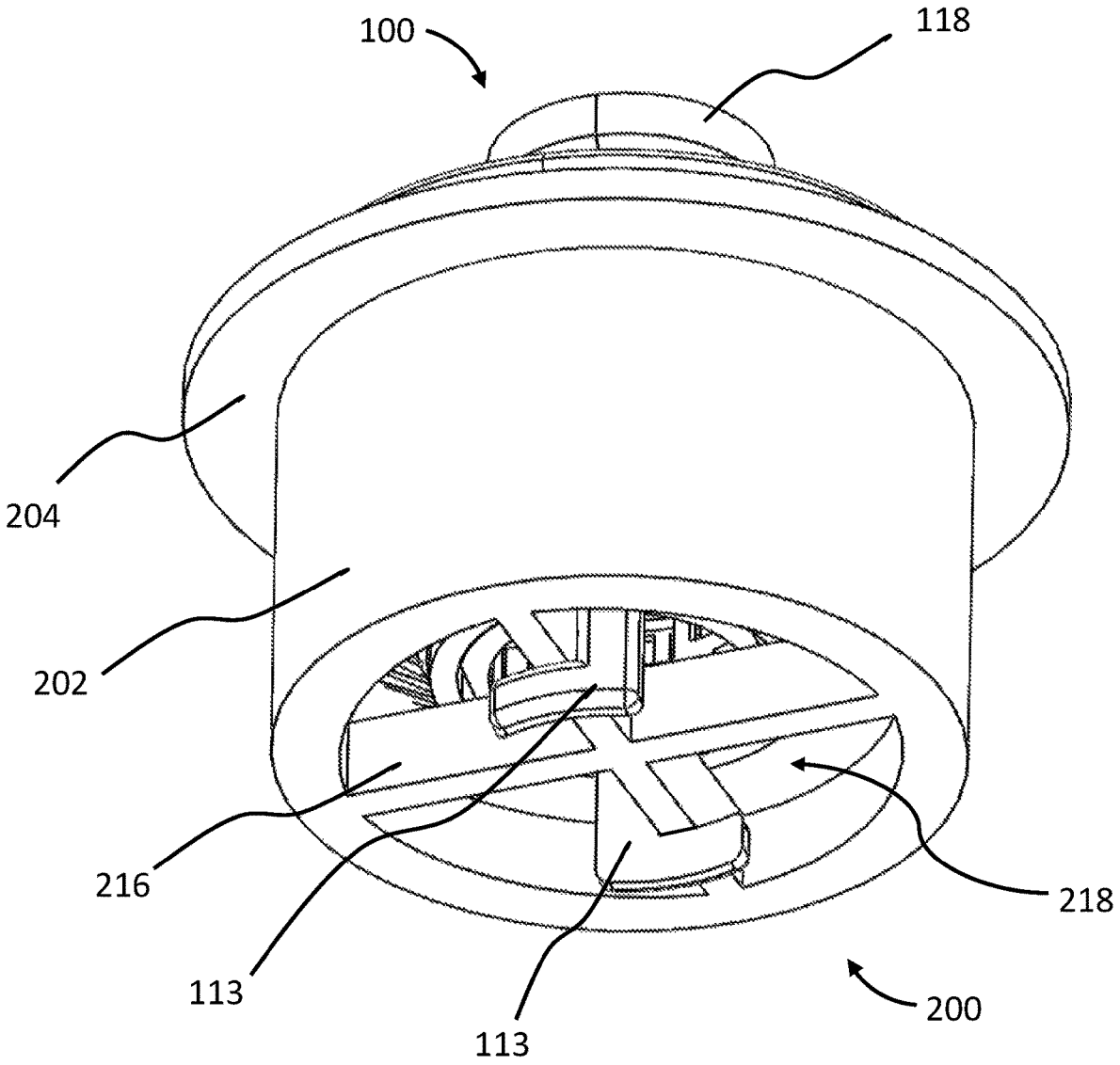
FIG. 3E is a bottom perspective view of the strainer cartridge in the drain as shown in FIG. 3A when the strainer cartridge is interlocked with a grate structure of the drain.

FIG. 3E is a bottom plan perspective view of the drain system 200 including the drain body 202 and the strainer cartridge 100. The drain body 202 further includes a grate structure 216 that is mechanically engaged with the clip arrangements 113 of the lower strainer portion 104. For example, the horizontal portions of the L-shaped clip arrangements 113 are below corresponding bars of the grate structure 216 such that upper surfaces of the horizontal portions may abut the lower surfaces of the corresponding bars, and the vertical portions of the L-shaped clip arrangements 113 are adjacent to and may abut side surfaces of the corresponding bars. The clip arrangements 113 interlock with the bars of the grate structure 216 such that when the user pulls upward on the stopper head 118 to mechanically move the upper strainer portion 102 from the compressed position towards the expanded position the clip arrangements 113 abut and interlock with the corresponding bars of the grate structure 216 such that the strainer cartridge 100 is not removed from the drain body 202. Alternatively, when the user pushes downward on the stopper head 118 to mechanically move the upper strainer portion 102 from the expanded position towards the compressed position, the bottom end of the lower strainer portion 104 is pushed against the grate structure 216 such that the upper strainer portion 102 is moved into the lower strainer portion 104.

Figure 3F:
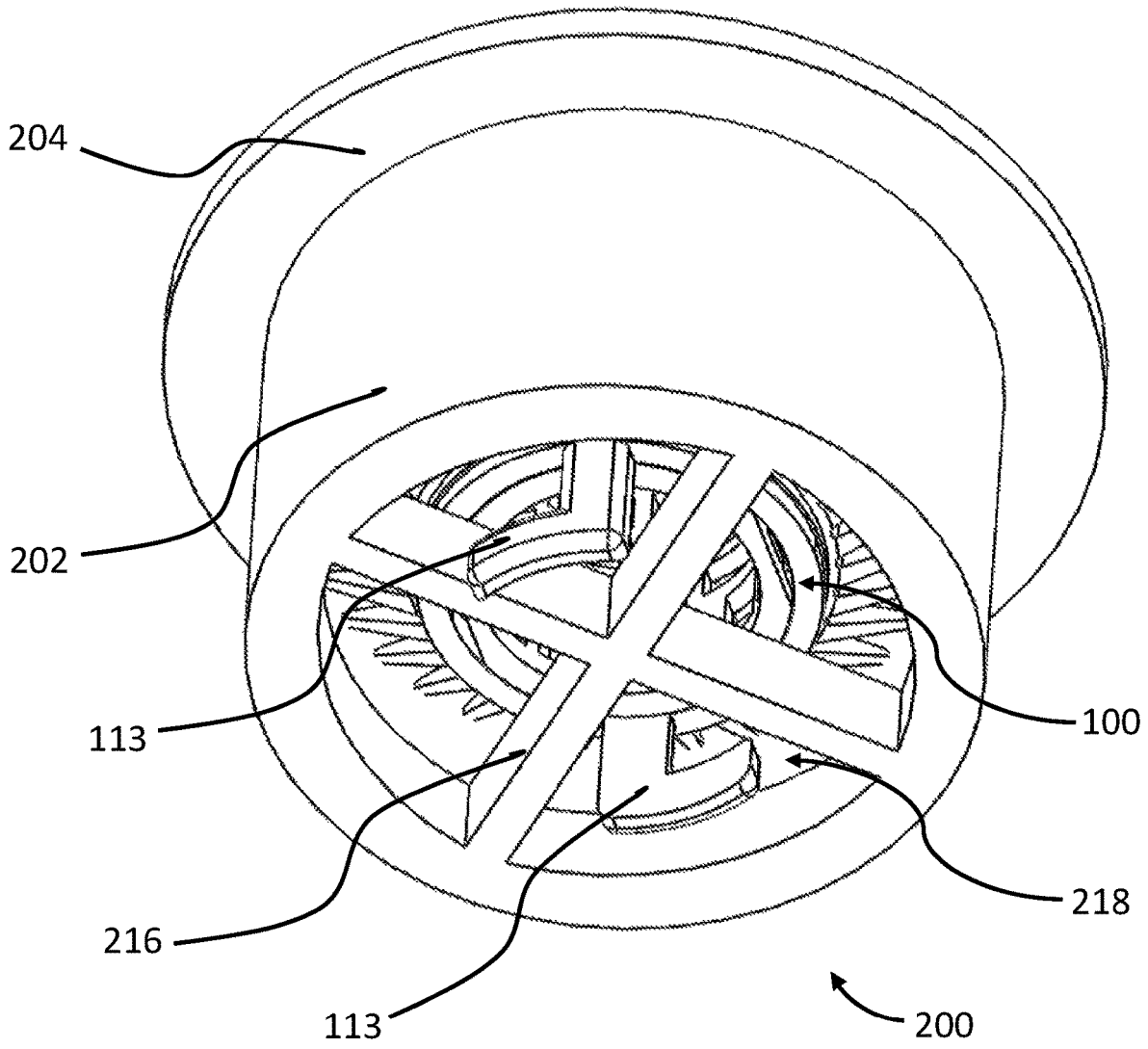
FIG. 3F is a bottom perspective view of the strainer cartridge in the drain as shown in FIG. 3A when the strainer cartridge is rotated and unlocked from the grate structure of the drain.

FIG. 3F is a bottom plan perspective view of the drain system including the drain body and the strainer cartridge 100. However, unlike FIG. 3E in which the clip arrangements 113 interlock with the grate structure 216, the strainer cartridge 100 has been rotated such that the clip arrangements are fully aligned with corresponding openings 218 extending through the grate structure 216. When in this rotated position, the clip arrangements 113 do not interlock with the corresponding bars of the grate structure 216 such that when a user pulls on the stopper head 118, the strainer cartridge 100 is removed from the drain body 202. The strainer cartridge 100 may be conveniently removed from the drain body 202 such that the strainer cartridge 100 may be cleaned, may have parts replaced, or may be replaced entirely by a new trainer cartridge 100.

Figure 4A:
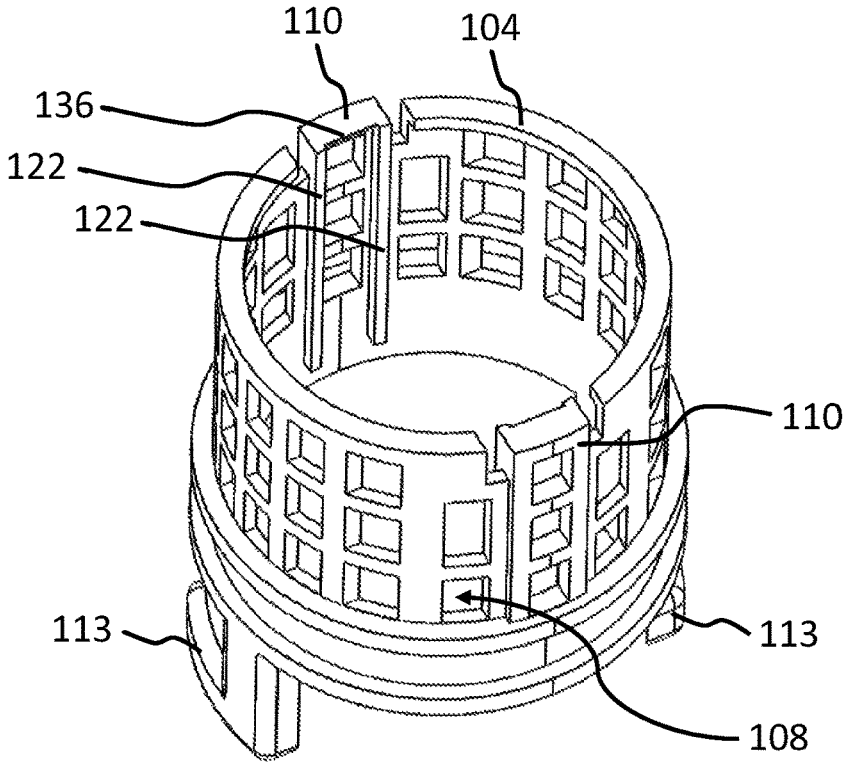
FIG. 4A is a perspective view of a lower strainer portion of the strainer cartridge as shown in FIGS. 1A-1F.
Figure 4B:
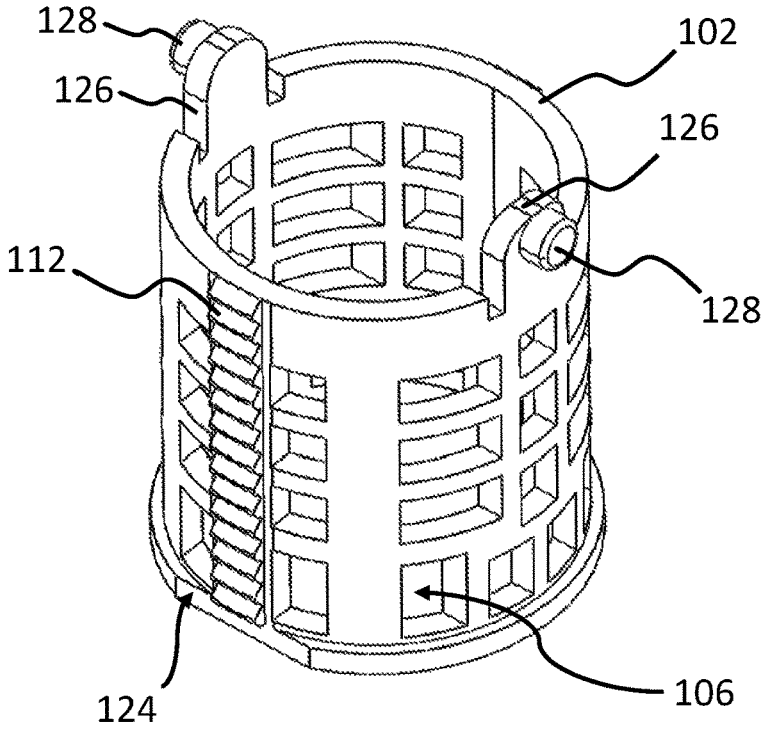
FIG. 4B is a perspective view of an upper strainer portion of the strainer cartridge as shown in FIGS. 1A-1F that is telescopically received by the lower strainer portion as shown in FIG. 4A.

FIG. 4A is a perspective view of the lower strainer portion 104 of the strainer cartridge 100 as shown in FIGS. 1A-1F. FIG. 4B is a perspective view of the upper strainer portion 102 of the strainer cartridge 100 as shown in FIGS. 1A-1F that is telescopically received by the lower strainer portion 104 as shown in FIG. 4A.

In some embodiments, the outside diameter of the lower strainer portion 104 may be less than the inside diameter of the upper strainer portion 102 such that the lower strainer portion 104 is telescopically received within the upper strainer portion 102. In other words, the upper strainer portion 102 may surround the lower strainer portion 104 when the strainer cartridge 100 is in the compressed position. In these embodiments, the cantilever arms 110 may be reversed such that the lip portions 136 are at an outer surface of the lower strainer portion 104 and the ribbed portions 112 are at an inner surface of the upper strainer portion 102 such that the cantilever arms 110 mechanically cooperate and engage with corresponding ones of the ribbed portion 112.

Additional aspects and features of the strainer cartridges disclosed herein will be readily apparent from a detailed review of the figures.

Furthermore, aspects and features of the embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A stopper assembly for a drain system of a fluid basin, the stopper assembly comprising:

a stopper head having a seal to sealingly engage with the drain system of the fluid basin when the stopper assembly is moved from a drain position to a plug position; and a telescopic strainer assembly including:

an upper strainer portion coupled to the stopper head, the upper strainer portion including an upper strainer sidewall having a plurality of apertures extending therethrough to strain a flow of fluid passing through the upper strainer portion during operation of the drain system, and a lower strainer portion telescopically engaged with the upper strainer portion to enable the upper strainer portion to telescopically move relative to the lower strainer portion and to enable the stopper head to move between the drain position and the plug position, the lower strainer portion including a lower strainer sidewall having a plurality of apertures extending therethrough to strain the flow of fluid passing through the lower strainer portion during operation of the drain system, and wherein the stopper assembly is configured to be installed and removed as a unit from a thru-cavity of a drain body of the drain system of the fluid basin defined by an inner sidewall of the drain body, and, when installed, is positioned such that the upper strainer sidewall and the lower strainer sidewall are each laterally offset from the inner sidewall of the drain body to allow at least a portion of the flow of fluid through the drain system during operation to pass between the upper strainer sidewall and the inner sidewall of the drain body and to pass between the lower strainer sidewall and the inner sidewall of the drain body.

2. The stopper assembly of claim 1, wherein the telescopic strainer assembly is removably coupled to the stopper head via one or more protrusions of the telescopic strainer assembly to enable decoupling of the stopper head from the telescopic strainer assembly.

3. The stopper assembly of claim 2, wherein the one or more protrusions are at ends of one or more elastically deformable tabs of the upper strainer portion configured to detachably engage with the stopper head.

4. The stopper assembly of claim 3, wherein the elastically deformable tabs are configured to deform inward towards a central axis of the telescopic strainer assembly to removably couple the stopper head to the upper strainer portion.

5. The stopper assembly of claim 1, wherein:

the lower strainer portion includes an anti-rotation structure; and the upper strainer portion includes a surface that abuts the anti-rotation structure delimiting rotation of the upper strainer portion relative to the lower strainer portion.

6. The stopper assembly of claim 1, wherein:

the lower strainer portion includes one or more clip structures to engage with a grate structure of the drain system to hold the lower strainer portion in a stationary position.

7. The stopper assembly of claim 1, wherein the upper strainer portion is at least partially telescopically inserted into the lower strainer portion in the plug position to sealingly engage the seal with a peripheral region of the drain body of the drain system.

8. The stopper assembly of claim 1, wherein the upper strainer portion has a first outer diameter and the lower strainer portion has a second outer diameter greater than the first outer diameter of the upper strainer portion to be telescopically inserted into the lower strainer portion.

9. The stopper assembly of claim 1, wherein the stopper head and the telescopic strainer assembly form a strainer cartridge that is removably insertable into the drain system.

10. The stopper assembly of claim 1, wherein:

the plurality of apertures of the upper strainer portion include apertures of different sizes and/or shapes; and the plurality of apertures of the lower strainer portion include apertures of different sizes and/or shapes.

11. A stopper assembly for a drain system of a fluid basin, the stopper assembly comprising:

a stopper head having a seal to sealingly engage with the drain system of the fluid basin when the stopper assembly is moved from a drain position to a plug position; and a telescopic strainer assembly including:

an upper strainer portion coupled to the stopper head, the upper strainer portion having a plurality of apertures to strain a flow of fluid passing through the upper strainer portion during operation of the drain system, and a lower strainer portion telescopically engaged with the upper strainer portion to enable the stopper head to move between the drain position and the plug position, the lower strainer portion having a plurality of apertures to strain the flow of fluid passing through the lower strainer portion during operation of the drain system;

wherein the upper strainer portion includes one or more ribbed regions having a plurality of ribs extending along the upper strainer portion; and wherein the lower strainer portion includes one or more elastically deformable cantilever arms having an end that slidably engages with the plurality of ribs of the one or more ribbed regions, the cantilever arms configured to deflect and snap between ones of the plurality of ribs of the one or more ribbed regions as the upper strainer portion is slidably moved into and out of the lower strainer portion.

12. The stopper assembly of claim 11, wherein the one or more cantilever arms are configured to deform outward from a central axis of the telescopic strainer assembly as the upper strainer portion is slidably moved into and out of the lower strainer portion.

13. A stopper assembly for a drain system of a fluid basin, the stopper assembly comprising:

a stopper head having a seal to sealingly engage with the drain system of the fluid basin when the stopper assembly is moved from a drain position to a plug position; and a telescopic strainer assembly including:

an upper strainer portion coupled to the stopper head and a lower strainer portion telescopically engaged with the upper strainer portion to enable the upper strainer portion to telescopically move relative to the lower strainer portion and to enable the stopper head to move between the drain position and the plug position, the upper strainer portion includes an upper strainer sidewall, and the lower strainer portion includes a lower strainer sidewall; and a lateral strainer portion coupled to the lower strainer portion, the lateral strainer portion including a plurality of fingers laterally extending away from the lower strainer portion that terminate at or proximate a sidewall of a drain body of the drain system, the lateral strainer portion is arranged circumferentially about the lower strainer portion, and wherein the stopper assembly is configured to be installed and removed as a unit from a thru-cavity of the drain body of the drain system of the fluid basin defined by an inner sidewall of the drain body, and, when installed, is positioned such that the upper strainer sidewall and the lower strainer sidewall are each laterally offset from the inner sidewall of the drain body to allow at least a portion of the flow of fluid through the drain system during operation to pass between the upper strainer sidewall and the inner sidewall of the drain body and to pass between the lower strainer sidewall and the inner sidewall of the drain body.

14. The stopper assembly of claim 13, wherein the plurality of fingers of the lateral strainer portion extend at an angle from the lower strainer portion directed upward towards the upper strainer portion to catch objects in a fluid flowing through the lateral strainer portion when operating the drain system.

15. The stopper assembly of claim 13, wherein:

the lower strainer portion includes an anti-rotation structure along an inner surface of the lower strainer portion; and the upper strainer portion includes an outer surface region that abuts the anti-rotation structure delimiting rotation of the upper strainer portion relative to the lower strainer portion.

16. The stopper assembly of claim 13, wherein the fingers of the lateral strainer abut the inner sidewall of the drain body to assist in positioning the upper strainer portion and the lower strainer portion in a central region of the drain body.

17. A stopper assembly for a drain system of a fluid basin, the stopper assembly comprising:

a stopper head having a seal to sealingly engage with the drain system of the fluid basin when the stopper assembly is moved from a drain position to a plug position; and a telescopic strainer assembly including:

an upper strainer portion coupled to the stopper head, the upper strainer portion including an upper strainer sidewall; and a lower strainer portion telescopically engaged with the upper strainer portion to enable the upper strainer portion to telescopically move relative to the lower strainer portion and to enable the telescopic strainer assembly to move between the drain position and the plug position, the lower strainer portion including a lower strainer sidewall radially offset from the upper strainer portion, wherein the upper and lower strainer portions of the telescopic strainer assembly collectively define a cylindrical void that extends from under the stopper head to a terminal end of the telescopic strainer assembly and is unobstructed along a central axis of the telescopic strainer assembly to strain a flow of fluid passing through the upper and lower strainer portions when the stopper head is in the drain position, and wherein the stopper assembly is configured to be installed and removed as a unit from a thru-cavity of a drain body of the drain system of the fluid basin defined by an inner sidewall of the drain body, and, when installed, is positioned such that the upper strainer sidewall and the lower strainer sidewall are each radially offset from the inner sidewall of the drain body to allow at least a portion of the flow of fluid through the drain system during operation to pass between the upper strainer sidewall and the inner grainer sidewall of the drain body and to pass between the lower strainer sidewall and the inner sidewall of the drain body.

18. The stopper assembly of claim 17, wherein:

the lower strainer portion includes an anti-rotation structure; and the upper strainer portion includes a boss that extends into and is received by the anti-rotation structure delimiting rotation of the upper strainer portion relative to the lower strainer portion.

19. The stopper assembly of claim 18, wherein the telescopic strainer assembly is inserted into the drain body of the drain system, and the upper and lower strainer portions are laterally spaced inward from a sidewall of the drain body.

20. The stopper assembly of claim 17, wherein the telescopic strainer assembly includes a lateral strainer portion coupled to the lower strainer portion of the telescopic strainer assembly, the lateral strainer portion including one or more fingers laterally extending away from the central axis of the telescopic strainer assembly that terminate proximate the inner sidewall of the drain body of the drain system in which the telescopic strainer assembly is present.

* * * * *